US011325233B2

(12) United States Patent
Akiba et al.

(10) Patent No.: US 11,325,233 B2
(45) Date of Patent: May 10, 2022

(54) DRIVING TOOL

(71) Applicant: MAKITA CORPORATION, Anjo (JP)

(72) Inventors: Yoshitaka Akiba, Anjo (JP); Kazusa Fukuda, Anjo (JP)

(73) Assignee: MAKITA CORPORATION, Anjo (JP)

( * ) Notice: Subject to any disclaimer, the term of this patent is extended or adjusted under 35 U.S.C. 154(b) by 246 days.

(21) Appl. No.: 16/759,535

(22) PCT Filed: Oct. 23, 2018

(86) PCT No.: PCT/JP2018/039396
§ 371 (c)(1),
(2) Date: Apr. 27, 2020

(87) PCT Pub. No.: WO2019/087873
PCT Pub. Date: May 9, 2019

(65) Prior Publication Data

US 2020/0276691 A1 Sep. 3, 2020

(30) Foreign Application Priority Data

Oct. 31, 2017 (JP) ..... JP2017-210633

(51) Int. Cl.
*B25C 1/06* (2006.01)
*B25C 1/00* (2006.01)

(52) U.S. Cl.
CPC ..... *B25C 1/06* (2013.01); *B25C 1/008* (2013.01)

(58) Field of Classification Search
CPC ..... B25C 1/06; B25C 1/008; B25C 5/13
(Continued)

(56) References Cited

U.S. PATENT DOCUMENTS 4,463,888 A * 8/1984 Geist ..... B25C 1/005 227/126
9,744,657 B2 8/2017 Baron et al.
(Continued)

FOREIGN PATENT DOCUMENTS

JP 2006-130592 A 5/2006
JP 2006-346855 A 12/2006
JP 2017-77613 A 4/2017

OTHER PUBLICATIONS

Jan. 8, 2019 Search Report issued in International Patent Application No. PCT/JP2018/039396.
(Continued)

*Primary Examiner* — Anna K Kinsaul
*Assistant Examiner* — Himchan Song
(74) *Attorney, Agent, or Firm* — Oliff PLC

(57) ABSTRACT

A nailing machine includes a tool body, a flywheel (40), a driver (3), a pressing mechanism and a return mechanism. The pressing mechanism includes a spring mechanism and a pressing roller (87). The pressing roller (87) is supported to be rotatable around a rotation axis (A2) and movable in a left-right direction, and configured to press the driver (3) toward the flywheel (40) by a biasing force of the spring mechanism in a nail-driving process in which the driver (3) moves from an initial position to a nail-driving position, to thereby enable transmission of the rotational energy to the driver (3). The pressing mechanism is configured such that the position of the pressing roller (87) relative to the driver (3) changes in the left-right direction between the nail-driving process and a return process, thereby making it impossible for the pressing roller (87) to press the driver (3) in the return process.

20 Claims, 22 Drawing Sheets

(58) Field of Classification Search
USPC ..... 227/8, 120, 131, 132, 129, 156
See application file for complete search history.

(56) References Cited

U.S. PATENT DOCUMENTS

| | | | | |
|---|---|---|---|---|
| 2006/0283910 | A1 | 12/2006 | Schiestl et al. | |
| 2008/0257933 | A1* | 10/2008 | Takahashi | B25C 1/06 227/129 |
| 2009/0294504 | A1 | 12/2009 | Kunz et al. | |
| 2012/0097729 | A1 | 4/2012 | Gross et al. | |
| 2013/0255984 | A1* | 10/2013 | Po | B25C 1/06 173/112 |
| 2014/0097223 | A1* | 4/2014 | Baron | B25C 1/06 227/129 |
| 2020/0061789 | A1* | 2/2020 | Dittrich | B25C 1/008 |

OTHER PUBLICATIONS

May 5, 2020 International Preliminary Report on Patentability issued in International Patent Application No. PCT/JP2018/039396.

* cited by examiner

DRIVING TOOL

TECHNICAL FIELD

The present invention relates to a driving tool which is configured to eject a fastener from an ejection outlet to drive the fastener into a workpiece.

BACKGROUND ART

A driving tool is known which is configured to eject a fastener such as a nail from an ejection outlet and drive the fastener into a workpiece by linearly moving a driver. For example, in a driving tool disclosed in U.S. Unexamined Patent Application Publication No. 2012/0097729, a roller supported by a roller assembly presses a driver against a flywheel by a biasing force of a spring. Thus, the driver and the flywheel are frictionally engaged with each other and rotational energy of the flywheel is transmitted to the driver. The driver is pushed out forward along a specified driving axis and drives out a nail from a nose part. After driving out the nail, the driver is returned to an initial position by a return mechanism.

SUMMARY

Technical Problem

In the above-described driving tool, the roller assembly is swingable. When the driver is moved forward, the roller assembly is swung forward and held so as to allow the roller to press the driver. On the other hand, when the driver is returned rearward to the initial position, the driver comes into contact with the roller and the roller assembly is swung rearward. Thus, the roller is prevented from inhibiting return of the driver to the initial position. In such a structure, a space is required to allow the roller assembly to swing, so that the machine tends to increase in size.

Accordingly, considering such circumstances, it is an object of the present invention to provide an improved technique for a pressing mechanism for pressing a driver, in a driving tool for driving a fastener into a workpiece by ejecting the fastener from an ejection outlet with the driver.

Solution to Problem

According to one aspect of the present invention, a driving tool is provided which is configured to eject a fastener from an ejection outlet to drive the fastener into a workpiece. This driving tool includes a tool body, a flywheel, a driver, a pressing mechanism and a return mechanism.

The tool body extends in a front-rear direction of the driving tool. the tool body has the ejection outlet on its front end. The flywheel is housed in the tool body. Further, the flywheel is configured to be rotationally driven around a first rotation axis. The first rotation axis extends in a direction which is orthogonal to the front-rear direction. The driver is disposed to face an outer periphery of the flywheel, and disposed to be movable between an initial position and a nail-driving position along an operation line. The operation line extends in the front-rear direction. Further, the driver is configured to move forward by rotational energy transmitted from the flywheel to thereby strike and drive the fastener into the workpiece.

The pressing mechanism is disposed on a side opposite to the flywheel across the driver in a facing direction in which the flywheel and the driver face each other. The pressing mechanism includes a first biasing part and at least one pressing roller. The at least one pressing roller is supported to be rotatable around a second rotation axis and to be movable in an extending direction of the second rotation axis. The second rotation axis extends in parallel to the first rotation axis. The at least one pressing roller is configured to press the driver toward the flywheel by a biasing force of the first biasing part in a nail-driving process, to thereby enable transmission of the rotational energy to the driver. The nail-driving process is a process in which the driver moves from the initial position to the nail-driving position. The return mechanism is configured to move the driver rearward from the nail-driving position to the initial position along the operation line.

Further, the pressing mechanism is configured such that a position of the at least one pressing roller relative to the driver changes in the extending direction of the second rotation axis between the nail-driving process and a return process, thereby making the at least one pressing roller to be incapable of pressing the driver in the return process. The return process is a process in which the driver moves from the nail-driving position to the initial position.

In the pressing mechanism of the present aspect, in the nail-driving process, the at least one pressing roller presses the driver by the biasing force of the first biasing part and thereby enables transmission of the rotational energy to the driver. Further, the position of the at least one pressing roller relative to the driver changes in the extending direction of a rotation axis of the pressing roller (the second rotation axis) between the nail-driving process and the return process, so that the pressing roller cannot press the driver in the return process. Therefore, according to the present aspect, the pressing roller can be prevented from inhibiting movement of the driver from the nail-driving position to the initial position. Further, the position of the at least one pressing roller relative to the driver can be changed by linearly moving the at least one pressing roller in the extending direction of the second rotation axis. Therefore, a space required for movement of the at least one pressing roller can be reduced, compared with a case in which the roller assembly is swung. Thus, size increase of the pressing mechanism can be suppressed.

It is noted that the rotational energy of the flywheel may be transmitted from the flywheel to the driver directly or via a transmitting member disposed between the flywheel and the driver. Further, the manner that the pressing roller "presses the driver in the nail-driving process" includes not only the manner that it "presses the driver over the whole nail-driving process" but also the manner that it "presses the driver in part of the nail-driving process". Further, the manner that the position of the at least one pressing roller relative to the driver "changes in an extending direction of the second rotation axis between the nail-driving process and the return process" includes not only the manner that this position differs completely (without any overlap) between the nail-driving process and the return process, but also the manner that the position differs partially (with partial overlap) between the nail-driving process and the return process.

According to one aspect of the present invention, the driver may have a roller-abutting part. The roller-abutting part may extend in the front-rear direction and may be configured to abut on the at least one pressing roller in the nail-driving process. The roller-abutting part may have a pressing-force-receiving surface to be pressed by the pressing roller in a state in which the driver receives the rotational energy in the nail-driving process. Further, a rear end of the pressing-force-receiving surface may be located forward of the second rotation axis when the driver is placed in the nail-driving position. In other words, when the driver moves forward to the nail-driving position in the nail-driving process, the at least one pressing roller may not be located on the pressing-force-receiving surface, so that the driver does not receive the rotational energy. Therefore, according to the present aspect, a state in which pressing of the at least one pressing roller against the driver is released can be established at the start of the return process in which the driver moves from the nail-driving position to the initial position.

According to one aspect of the present invention, the at least one roller may include two rollers. The two rollers may be arranged on opposite sides of the operation line in the extending direction of the second rotation axis. Further, the pressing mechanism may include a second biasing part configured to bias the two rollers toward each other. Further, the two rollers may be configured to be held in proximate positions where the two rollers are proximate to each other by a biasing force of the second biasing part in the nail-driving process, and to be held in positions where the two rollers are separated further apart from each other than in the proximate positions against the biasing force of the second biasing part in the return process. According to the present aspect, a structure for holding the at least one roller in different positions in the extending direction of the second rotation axis can be easily realized by utilizing the biasing force of the second biasing part.

According to one aspect of the present invention, a rear end portion of the driver may have a pair of guide surfaces. The pair of guide surfaces may be at least inclined such that a distance between the pair of guide surfaces in the extending direction of the second rotation axis increases toward the front. The pair of guide surfaces having such a structure can guide the two rollers to move away from each other in the extending direction of the second rotation axis in the return process. In other words, the pair of guide surfaces can move the two rollers in the extending direction of the second rotation axis as the driver moves rearward from the nail-driving position. Therefore, it is not necessary to separately provide a structure for moving the two rollers, so that size increase and complication of the pressing mechanism can be prevented.

According to one aspect of the present invention, the pair of guide surfaces may further be inclined in a direction away from the two rollers toward the rear. The pair of guide surfaces having such a structure can guide the two rollers to move away from each other while reducing the pressing force of the rollers against the driver, in the nail-driving process. In other words, as the driver moves toward the nail-driving position, the pair of guide surfaces can move the two rollers in the extending direction of the second rotation axis while reducing the pressing force of the rollers against the driver. Therefore, after reaching the nail-driving position, the driver can smoothly shift to the return process.

According to one aspect of the present invention, the two rollers may be guided along the roller-abutting part respectively in abutment with opposite sides of the roller-abutting part by the biasing force of the second biasing part in the return process. When the driver returns to the initial position, the two rollers may be released from abutment with the roller-abutting part and return to the proximate positions by the biasing force of the second biasing part. According to the present aspect, in the return process and when the driver returns to the initial position, the two rollers can be held in appropriate positions in the extending direction of the second rotation axis by utilizing the roller-abutting part and the biasing force of the second biasing part. Further, it is not necessary to separately provide a structure for holding the two rollers in the positions to be separated further apart from each other than in the proximate positions in the return process. Therefore, size increase and complication of the pressing mechanism can be prevented.

According to one aspect of the present invention, the second biasing part may include a conical coil spring. The conical coil spring is a spring which has a smaller solid height than a cylindrical coil spring. Therefore, the length of the pressing mechanism can be reduced in the extending direction of the second rotation axis by using the conical coil spring.

DESCRIPTION OF EMBODIMENTS

An embodiment of the present invention is now described with reference to the drawings. A nailing machine 1 is described as an example of a driving tool, with reference to FIGS. 1 to 22. The nailing machine 1 is a tool which is capable of performing a nail-driving operation of driving a nail 101 into a workpiece (such as wood) 100 by linearly driving out the nail 101 from an ejection outlet 123.

Figure 1:
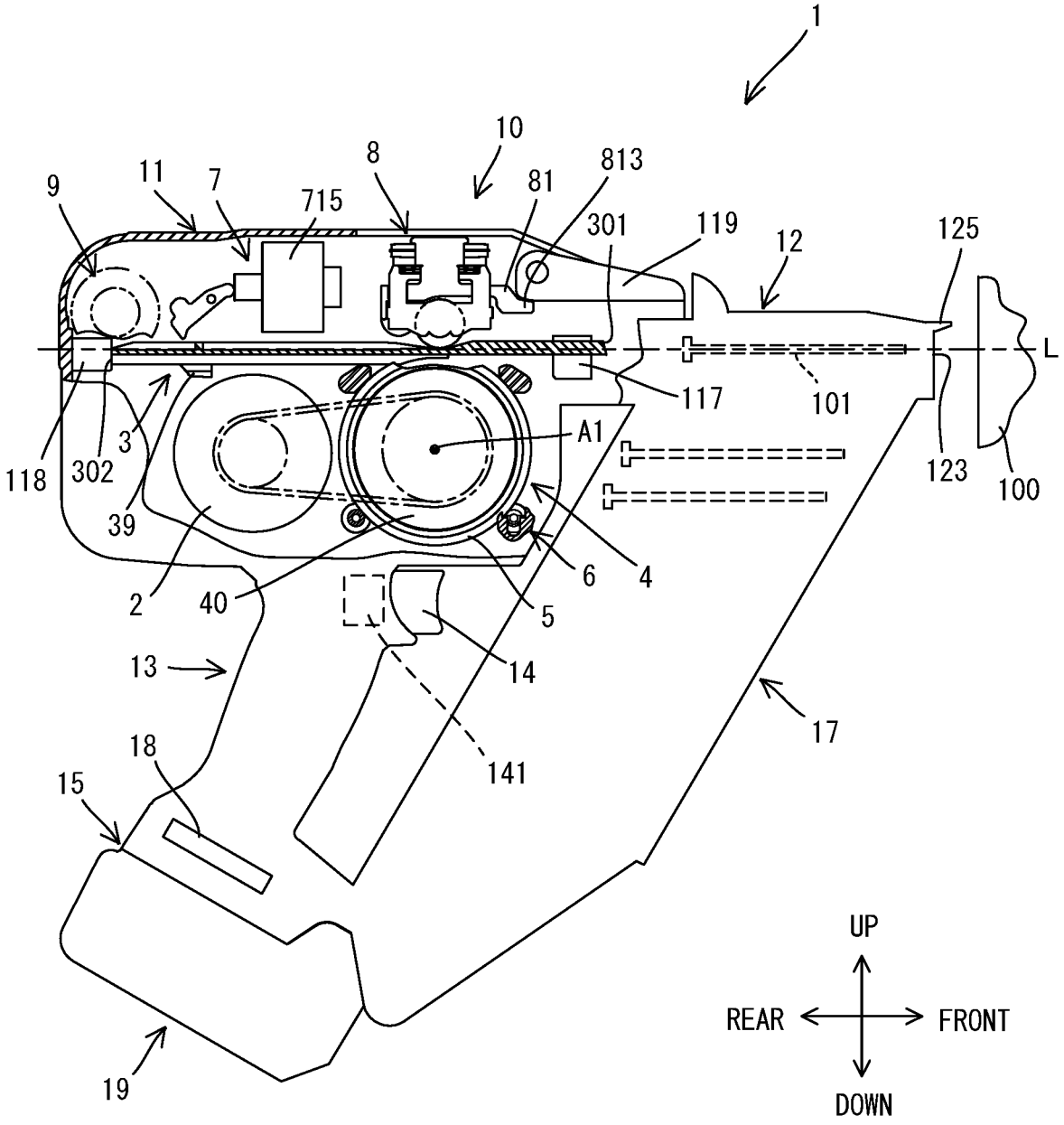
FIG. 1 is an explanatory drawing showing an overall structure of a nailing machine when a driver is located in an initial position.

First, the general structure of the nailing machine 1 is described with reference to FIG. 1. As shown in FIG. 1, an outer shell of the nailing machine 1 of the present embodiment is mainly formed by a tool body 10, a handle 13 and a magazine 17.

The tool body 10 includes a body housing 11 and a nose part 12. The body housing 11 houses a motor 2, a driver 3, a driver-driving mechanism 4 and a return mechanism 9. The driver 3 is disposed to be linearly movable along a specified operation line L. The driver-driving mechanism 4 is configured to drive out the nail 101 from the nailing machine 1 by moving the driver 3 along the operation line L. The return mechanism 9 is configured to return the driver 3 to an initial position after the driver 3 drives out the nail 101. The nose part 12 is connected to one end of the body housing 11 in an extending direction of the operation line L (hereinafter simply referred to as an operation-line-L direction). The nose part 12 has a driver passage (not shown) which extends through the nose part 12 in the operation-line-L direction. One end of the driver passage is open to the inside of the body housing 11. The other end of the driver passage is open to the outside of the nailing machine 1, as an ejection outlet 123 through which the nail 101 may be driven out. A contact arm 125, which is configured to be movable in the operation-line-L direction, is held adjacent to the ejection outlet 123 on the nose part 1. Further, a contact-arm switch (not shown) is disposed within the body housing 11. The contact-arm switch is configured to be normally kept in an OFF state while being turned ON when the contact arm 125 is pressed.

The handle 13 extends in a direction that intersects the operation line L, from a central portion of the body housing 11 in the operation-line-L direction. The handle 13 is a portion to be held by a user. A trigger 14, which may be depressed by a user, is provided in a base end portion (an end portion connected to the body housing 11) of the handle 13. A trigger switch 141 is disposed within the handle 13. The trigger switch 14 is configured to be normally kept in an OFF state while being turned ON when the trigger 14 is depressed. Further, a battery mounting part 15 having terminals is provided on a distal end portion (an end portion opposite to the base end portion) of the handle 13. A rechargeable battery 19 is removably mounted to the battery mounting part 15. A controller 18 for controlling operation of the nailing machine 1 is disposed inside the distal end portion of the handle 13. The contact-arm switch, the trigger switch 141, the motor 2 and a solenoid 715 are electrically connected to the controller 18.

The magazine 17 is configured to be loaded with a plurality of nails 101 and mounted to the nose part 12. The nails 101 loaded in the magazine 17 are fed one by one to the driver passage by a nail-feeding mechanism (not shown). The structure of the magazine 17 is well known and therefore its description is omitted.

The detailed structure of the nailing machine 1 is now described. In the following description, for convenience sake, the operation-line-L direction of the driver 3 (a left-right direction in FIG. 1) is defined as a front-rear direction of the nailing machine 1. In the front-rear direction, the ejection outlet 123 side (right side in FIG. 1) is defined as a front side of the nailing machine 1, while its opposite side (a left side in FIG. 1) is defined as a rear side. Further, a direction (an up-down direction in FIG. 1) which is orthogonal to the operation-line-L direction and which corresponds to the extending direction of the handle 13 is defined as an up-down direction of the nailing machine 1. In the up-down direction, the side (an upper side in FIG. 1) on which the handle 13 is connected to the tool body 10 (the body housing 11) is defined as an upper side, while the side (a lower side in FIG. 1) of the distal end portion (the end portion on which the battery 19 is mounted) of the handle 13 is defined as a lower side. Further, a direction which is orthogonal to the front-rear direction and to the up-down direction is defined as a left-right direction.

Figure 2:
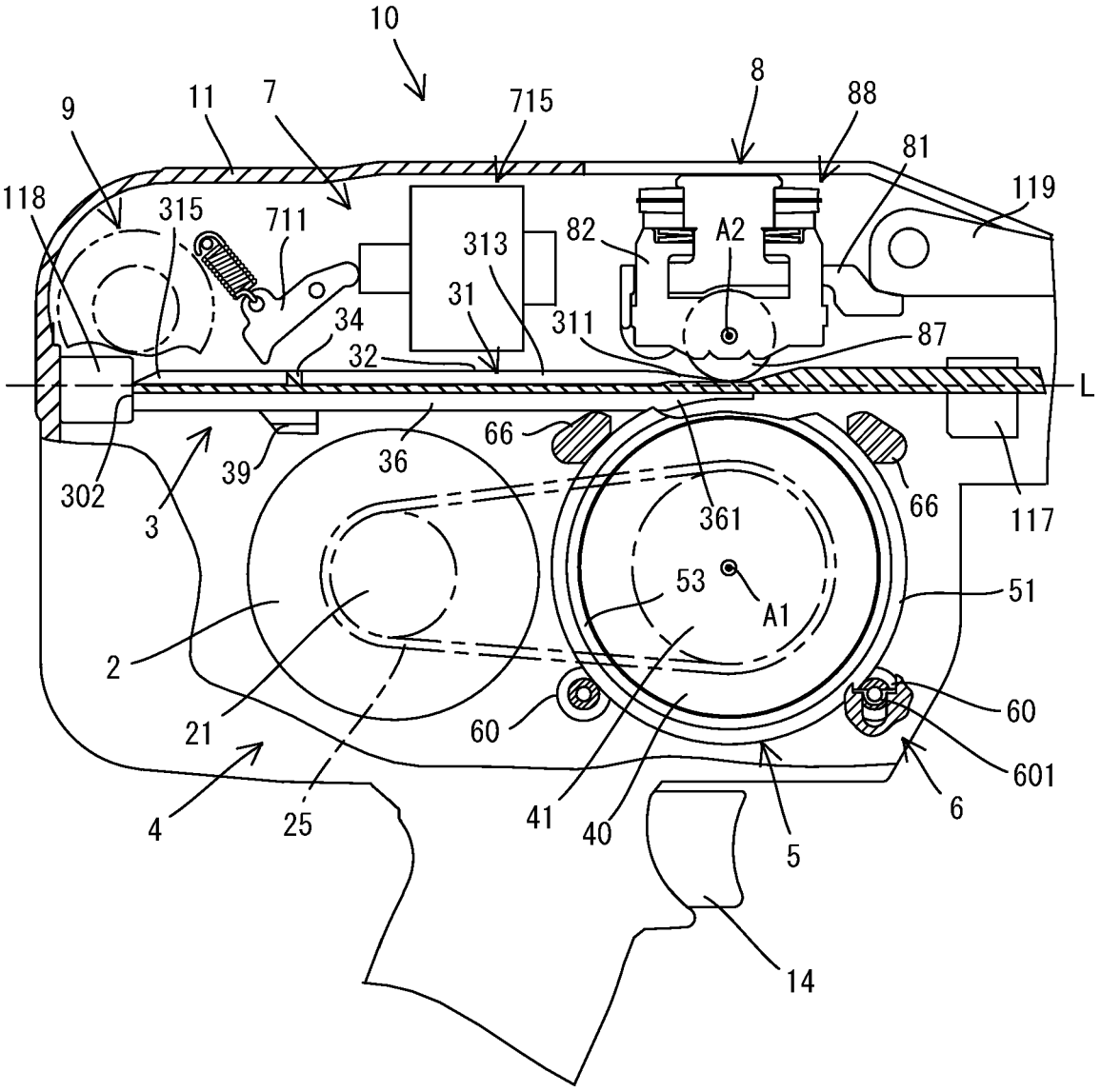
FIG. 2 is a partial, enlarged view of FIG. 1.

The motor 2, the driver 3 and the driver-driving mechanism 4 which are housed within the body housing 11 are first described in this order. In FIGS. 1 and 2, for convenience of explanation, a ring member 5 described below is shown partially cutaway.

The motor 2 is described. As shown in FIG. 2, the motor 2 is housed in a rear lower portion of the body housing 11. Further, the motor 2 is arranged such that a rotation axis of an output shaft (not shown) extends in the left-right direction, perpendicular to the operation line L. In the present embodiment, a compact and high-output brushless DC motor is adopted as the motor 2. A pulley 21, which rotates together with the output shaft, is connected to the output shaft of the motor 2. It is noted that, in the present embodiment, when the contact arm 125 (see FIG. 1) on the nose part 12 is pressed against a workpiece 100 and the contact-arm switch is turned on, the controller 18 controls to supply current from the battery 19 to the motor 2 to start driving of the motor 2.

Figure 3:
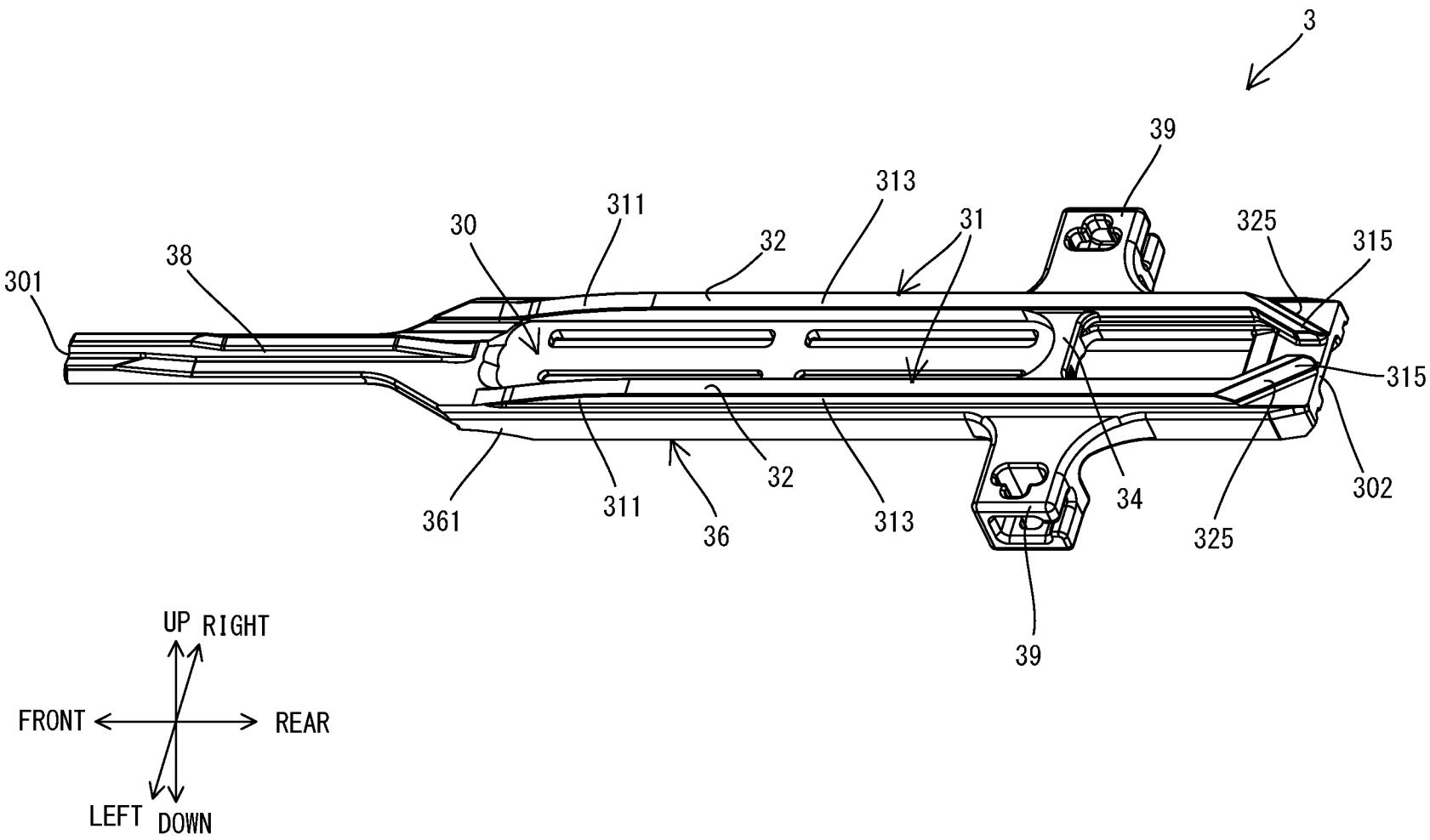
FIG. 3 is a perspective view of the driver as viewed from above.
Figure 4:
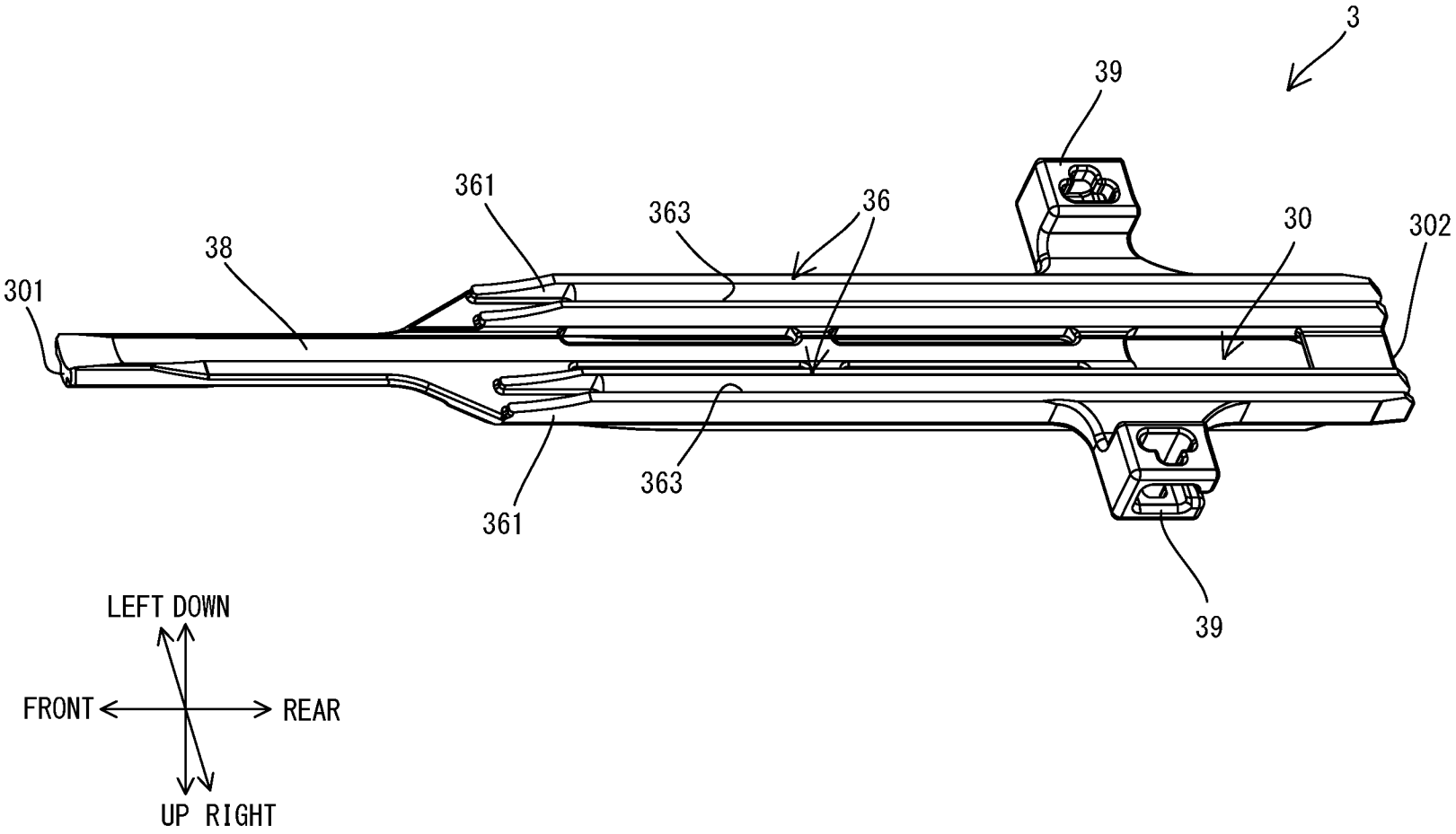
FIG. 4 is a perspective view of the driver as viewed from below.

The driver 3 is described. As shown in FIGS. 3 and 4, the driver 3 is an elongate member. The driver 3 is formed symmetrically relative to its longitudinal axis extending in the front-rear direction. The driver 3 includes a body part 30, a striking part 38 and a pair of arm parts 39. The body part 30 is a portion having a generally rectangular plate-like shape as a whole. The striking part 38 is a portion which extends forward from a front end of the body part 30, and has a smaller width than the body part 30 in the left-right direction. The pair of arm parts 39 protrude to the left and right from a rear portion of the body part 30.

The body part 30 is a portion to be pressed by pressing rollers 87 (see FIG. 2) described below and to be frictionally engaged with the ring members 5 (see FIG. 2). The body part 30 has a pair of roller-abutting parts 31, a lever-abutting part 34 and a pair of ring-engagement parts 36, which are now described in this order.

As shown in FIG. 3, the pair of roller-abutting parts 31 are integrally formed with the body part 30, such that the roller-abutting parts 31 protrude upward from an upper surface of the body part 30 and extend substantially in the front-rear direction as a whole. A surface (an upper surface) formed on a protruding end of each roller-abutting part 31 is formed as an abutment surface 32. The abutment surface 32 is a surface which abuts on an outer peripheral surface of the pressing roller 87 in a process in which the driver 3 moves from an initial position to a nail-driving position (which process is described below and hereinafter referred to as a nail-driving process). Further, each of the roller-abutting parts 31 has a push-up part 311, a straight part 313 and a roller-guide part 315 in this order from the front. When the roller-abutting parts 31 are viewed from above, their respective push-up parts 311 and straight parts 313 extend in the front-rear direction in parallel to each other along left and right edges of the body part 30. On the other hand, the roller-guide parts 315 of the roller-abutting parts 31 are inclined toward each other (in other words, toward the longitudinal axis of the driver 3 or toward the operation line L of the nailing machine 1) in a direction toward the rear. Thus, the roller-guide parts 315 form a V-shape having an apex on a rear end when viewed from above.

The push-up part 311 forms a front end portion of the roller-abutting part 31. The push-up part 311 is configured to push up the pressing roller 87 against the biasing force of a spring mechanism 88 in an initial stage of the nail-driving process. More specifically, the push-up part 311 has a height (a thickness in the up-down direction from the upper surface of the body part 30 to the protruding end surface (the upper surface of the protruding end)) gradually increasing toward the rear. The upper surface of the push-up part 311 is gently inclined upward toward the rear.

The straight part 313 extends rearward from the push-up part 311 and forms most of the roller-abutting part 31. The straight part 313 is a portion to be pressed by the pressing roller 87 while receiving the maximum load of the spring mechanism 88. The straight part 313 has a constant height. An upper surface of the straight part 313 extends substantially in parallel to the upper surface of the body part 30.

The roller-guide part 315 forms a rear end portion of the roller-abutting part 31. The roller-guide part 315 is configured to guide the pressing roller 87 in a final stage of the nail-driving process and in an initial stage of a process in which the driver 3 returns from the nail-driving position to the initial position after driving the nail 101 (which process is hereinafter referred to as a return process). More specifically, in the final stage of the nail-driving process, the roller-guide parts 315 guide the two pressing rollers 87 to move downward and also to move away from each other in the left-right direction. Further, in the initial stage of the return process, the roller-guide parts 315 guide the pressing rollers 87 to move away from each other in the left-right direction. The pair of roller-guide parts 315 have a corresponding pair of guide surface 325. The pair of guide surfaces 325 are inclined such that a distance between the guide surfaces 325 increases in the left-right direction (in other words, the guide surfaces 325 are inclined in a direction away from each other) toward the front. The pair of guide surfaces 325 are also inclined downward toward the rear.

The lever-abutting part 34 is formed to protrude upward from the upper surface of the body part 30. The lever-abutting part 34 extends in the left-right direction so as to connect the left and right roller-abutting parts 31 (the straight parts 313) in the rear portion of the body part 30. A push-out lever 711 described below may abut on the lever-abutting part 34 from the rear.

As shown in FIG. 4, the pair of ring-engagement parts 36 are integrally formed with the body part 30, such that the ring-engagement parts 36 protrude downward from a lower surface of the body part 30 and extend in the front-rear direction along the right and left edges of the body part 30. A front end portion of each ring-engagement part 36 is formed as an inclined part 361 which has a height (a thickness in the up-down direction) gradually increasing toward the rear. The ring-engagement parts 36 have respective engagement grooves 363. The engagement grooves 363 are grooves which are respectively engageable with outer peripheral engagement parts 51 of two ring members 5 described below. Each of the engagement grooves 363 is recessed upward from a protruding end of the ring-engagement part 36, and extends over the whole length of the ring-engagement part 36 in the front-rear direction. Further, the engagement groove 363 is formed to have a width in the left-right direction decreasing toward the top (in other words, such that left and right wall surfaces of the ring-engagement part 36 which define the engagement groove 363 get closer to each other toward the top) (see FIG. 7). Engagement between the driver 3 and the ring members 5 will be described in detail below.

A rear end 302 of the body part 30 defines a rear end of the driver 3. The rear end 302 is a portion which prevents the driver 3 from further moving rearward by abutting on a rear stopper part 118 (see FIG. 2). The rear stopper part 118 is fixed within a rear end portion of the body housing 11. A front end 301 of the striking part 38 defines a front end of the driver 3. The front end 301 is a portion configured to strike a head of the nail 101 (see FIG. 1) to drive the nail 101 forward into the workpiece 100.

The pair of arm parts 39 protrude to the left and right from the body part 30. The arm parts 39 are portions configured to prevent the driver 3 from further moving forward by abutting on a pair of front stopper parts 117 (see FIG. 2). The front stopper parts 117 are fixed within a front end portion of the body housing 11. The arm parts 39 are connected to the return mechanism 9 (see FIG. 12) described below.

The driver 3 having the above-described structure is disposed such that its longitudinal axis extends along the operation line L in the front-rear direction of the nailing machine 1. Further, the driver 3 is disposed to be movable between the initial position and the nail-driving position along the operation line L (in other words, in the front-rear direction of the nailing machine 1 or in the longitudinal direction of the driver 3).

Figure 5:
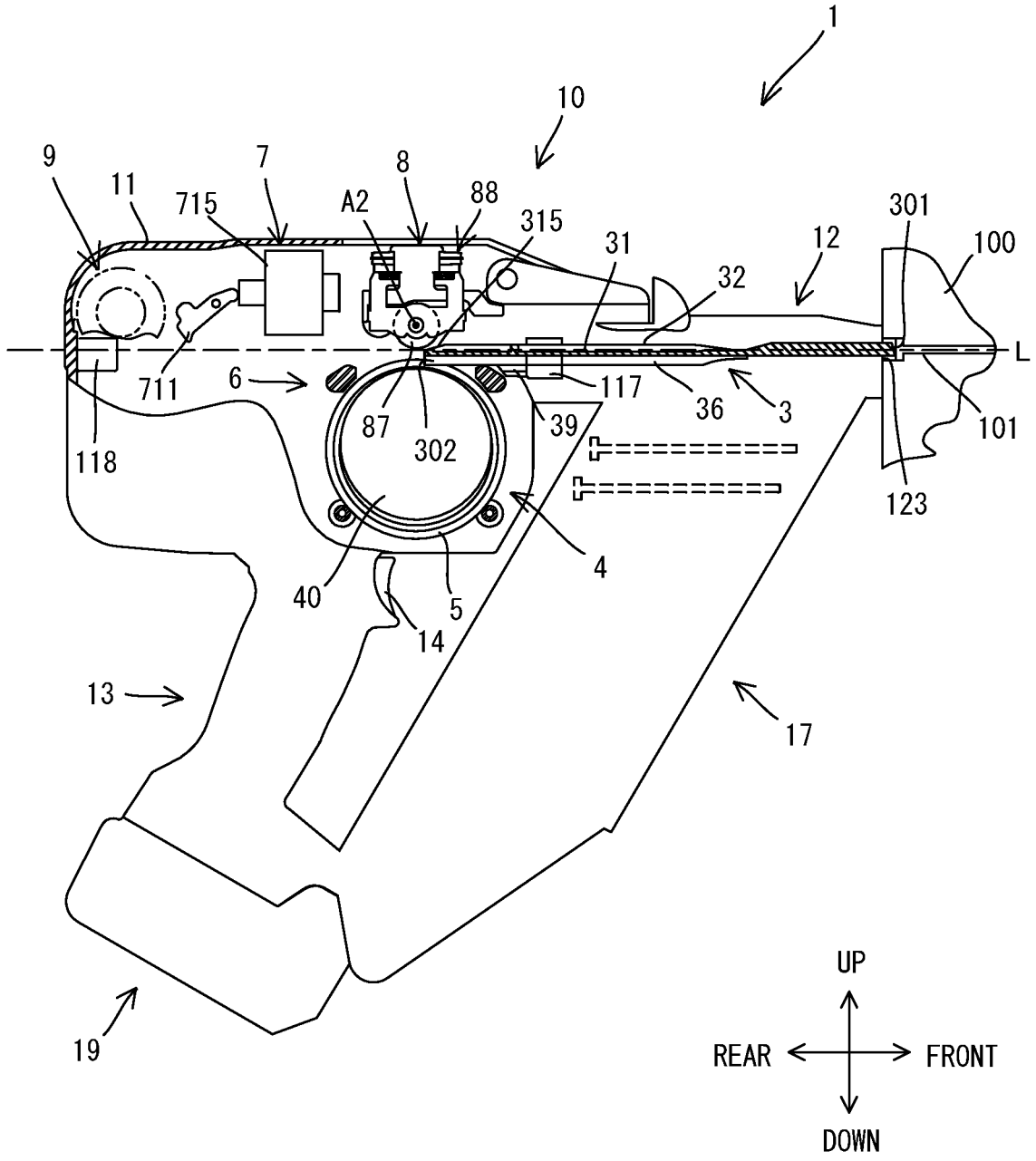
FIG. 5 is an explanatory drawing showing the overall structure of the nailing machine when the driver is located in a nail-driving position.

The initial position and the nail-driving position of the driver 3 are now described with reference to FIGS. 1 and 5. The initial position is a position where the driver 3 is held in a state that the driver-driving mechanism 4 is not actuated (hereinafter referred to as an initial state). In the present embodiment, as shown in FIG. 1, the initial position of the driver 3 is set to a position where the rear end 302 of the driver 3 abuts on the rear stopper part 118. The nail-driving position is a position where the driver 3 drives the nail 101 into a workpiece after being moved forward by the driver-driving mechanism 4. In the present embodiment, as shown in FIG. 5, the nail-driving position of the driver 3 is set to a position where the front end 301 of the driver 3 slightly protrudes from the ejection outlet 123. The nail-driving position is also a position where front ends of the pair of arm parts 39 abut on the pair of front stopper parts 117 from the rear.

With the above-described arrangement, in the present embodiment, the initial position and the nail-driving position can also be respectively referred to as a rearmost position and a foremost position which define a movable range of the driver 3 which moves along the operation line L. It is noted that the front stopper parts 117 and the rear stopper part 118 are formed of a cushioning material in order to alleviate impact of collision of the driver 3.

The detailed structure of the driver-driving mechanism 4 is described. In the present embodiment, as shown in FIG. 2, the driver-driving mechanism 4 includes a flywheel 40, the two ring members 5, a holding mechanism 6, an actuating mechanism 7 and a pressing mechanism 8. The structures of these components are now described in detail in this order.

The flywheel 40 is described. As shown in FIG. 2, the flywheel 40, which has a cylindrical shape, is rotatably supported in front of the motor 2 within the body housing 11. The flywheel 40 is rotationally driven around a rotation axis A1 by the motor 2. The rotation axis A1 extends in parallel to a rotation axis of the motor 2 and in the left-right direction which is orthogonal to the operation line L of the driver 3. A pulley 41, which rotates together with the support shaft and the flywheel 40, is connected to a support shaft (not shown) of the flywheel 40. A belt 25 is looped over the pulleys 21 and 41. When the motor 2 is driven, rotation of the output shaft of the motor 2 is transmitted to the flywheel 40 via the belt 25, and the flywheel 40 rotates clockwise as viewed in FIG. 2.

Figure 6:
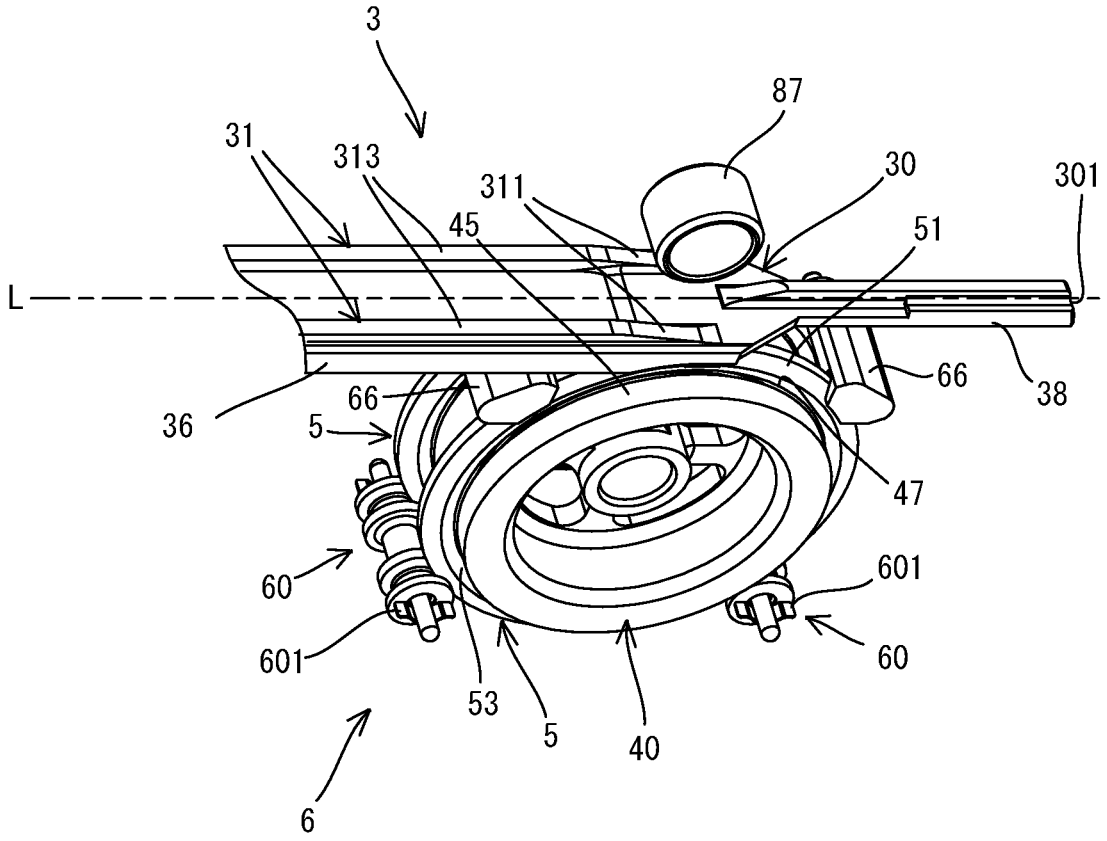
FIG. 6 is a perspective view showing a flywheel, ring members, a holding mechanism and a pressing roller when the driver is located in the initial position.
Figure 7:
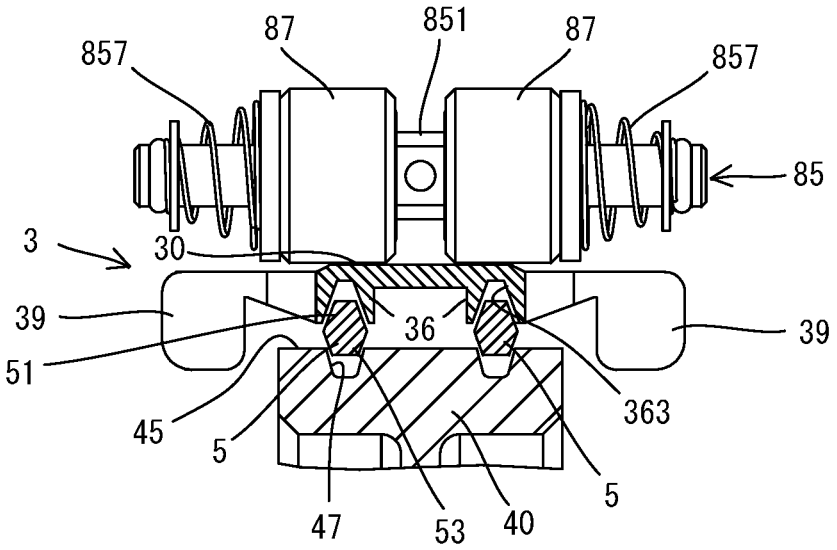
FIG. 7 is an explanatory drawing for illustrating the arrangement of the pressing rollers, the driver, the ring members and the flywheel when the driver is located in the initial position.

As shown in FIGS. 6 and 7, a pair of engagement grooves 47 are formed in an outer periphery 45 of the flywheel 40 to extend over the whole circumference of the flywheel 40. The ring members 5 are respectively engageable with the engagement grooves 47. Each of the engagement grooves 47 is formed such that its width in the left-right direction decreases toward the inner side in a radial direction of the flywheel 40.

The ring members 5 are described. As shown in FIG. 6, each of the ring members 5 has a ring-like shape having a larger diameter than the flywheel 40. In the present embodiment, the inner diameter of the ring member 5 is set to be larger than the outer diameter of the flywheel 40 (strictly, the diameter from the rotation axis A1 of the flywheel 40 to the bottom of the engagement groove 47). The two ring members 5 are disposed radially outward of the flywheel 40 relative to the engagement grooves 47 formed in the outer periphery 45 of the flywheel 40. In the present embodiment, each of the two ring members 5 is held by the holding mechanism 6 described below so as to be movable between a separate position where it is apart from the outer periphery 45 (more specifically, the engagement groove 47) of the flywheel 40 and a contact position where it is in partial contact with the outer periphery 45 (the engagement groove 47).

Each of the ring members 5 is a transmitting member for transmitting the rotational energy of the flywheel 40 to the driver 3, and configured to be frictionally engaged with the driver 3 and the flywheel 40. Specifically, as shown in FIG. 7, the outer peripheral engagement part 51, which is engageable with the engagement groove 363 of the driver 3, is provided in an outer periphery of the ring member 5. More specifically, the outer peripheral engagement part 51 is formed as a protrusion protruding outward in the radial direction of the ring member 5. Further, an inner peripheral engagement part 53, which is engageable with the engagement groove 47 of the flywheel 40, is formed in an inner periphery of the ring member 5. The inner peripheral engagement part 53 is formed as a protrusion protruding inward in the radial direction of the ring member 5.

It is noted that the ring member 5 has a generally hexagonal section in the radial direction. The outer peripheral engagement part 51 is formed such that its thickness decreases toward the outer side in the radial direction of the ring member 5, and the inner peripheral engagement part 53 is formed such that its thickness in the axial direction decreases toward the inner side in the radial direction of the ring member 5. Thus, both the outer peripheral engagement part 51 and the inner peripheral engagement part 53 are formed to have a section tapered toward their respective distal ends. Engagement of the ring member 5 with the driver 3 and with the flywheel 40 will be described in detail below.

The holding mechanism 6 is described. The holding mechanism 6 is configured to hold the ring members 5 such that the ring members 5 can move between their respective separate positions and the contact positions. As shown in FIG. 6, the holding mechanism 6 of the present embodiment includes a pair of ring-biasing parts 60 and a pair of stoppers 66. The pair of ring-biasing parts 60 are respectively disposed diagonally forward and downward of the ring members 5 and diagonally rearward and downward of the ring members 5. The pair of ring-biasing parts 60 rotatably support the ring members 5 while biasing the ring members 5 upward from below by flat springs 601. The pair of stoppers 66 are disposed below the driver 3 and respectively diagonally forward and upward of the ring members 5 and diagonally rearward and upward of the ring members 5. The pair of stoppers 66 are configured to restrict upward movement of the ring members 5 while allowing the ring members 5 to rotate.

The manner of holding the ring members 5 by the holding mechanism 6 is now described. As shown in FIG. 6, in the initial state, the ring-biasing parts 60 abut on the ring members 5 from below to bias the ring members 5 upward. Further, the stoppers 66 abut on the ring members 5 from above to prevent the ring members 5 from further moving upward. Thus, as shown in FIG. 7, the ring members 5 are held in their separate positions apart from the outer periphery 45 (the engagement grooves 47) over the whole circumference of the flywheel 40. Although only an upper end portion of the flywheel 40 is shown, the ring members 5 are similarly held apart from the outer periphery 45 (more specifically, the engagement grooves 47) of the flywheel 40 over the whole circumference of the flywheel 40. When the driver 3 is moved forward by the actuating mechanism 7 and presses the ring members 5 downward, the ring members 5 are moved downward against the biasing forces of the ring-biasing parts 60. As a result, the ring members 5 are held in their contact positions in contact with the outer periphery 45 (the engagement grooves 47) on an upper portion of the flywheel 40 (see FIG. 15), which will be described in further detail below.

The actuating mechanism 7 is described. As shown in FIG. 2, the actuating mechanism 7 is disposed above the driver 3 and rearward of the flywheel 40 within the body housing 11. The actuating mechanism 7 is configured to move the driver 3 along the operation line L from the initial position to a transmitting position described below. In the present embodiment, the actuating mechanism 7 mainly includes the solenoid 715 and the push-out lever 711. The solenoid 715 is actuated by the controller 18 (see FIG. 1) when the trigger switch 141 (see FIG. 1) is switched on. The push-out lever 711 is disposed to be rotatable around a rotation axis extending in the left-right direction. The push-out lever 711 is turned along with actuation of the solenoid 715. In the initial state, a tip end portion of the push-out lever 711 is located diagonally upward and rearward of the lever-abutting part 34 of the driver 3. When the solenoid 715 is actuated, the push-out lever 711 is turned in a counterclockwise direction as viewed in FIG. 2, and the tip end portion of the push-out lever 711 pushes the lever-abutting part 34 forward from the rear and thus moves the driver 3 forward (see FIG. 14). Operations of the driver 3 and the driver-driving mechanism 4 will be described in detail below.

The pressing mechanism 8 is described. As shown in FIG. 2, the pressing mechanism 8 is disposed within the body housing 11 on the side opposite to the flywheel 40 across the driver 3 in a facing direction (up-down direction) in which the flywheel 40 and the driver 3 face each other. In other words, the pressing mechanism 8 is disposed such that the pressing mechanism 8 faces the driver 3 from above. The pressing mechanism 8 is configured to press the driver 3 toward the ring members 5 (that is, in a direction toward the flywheel 40) in the process in which the driver 3 moves forward from the initial position, to thereby enable transmission of the rotational energy of the flywheel 40 to the driver 3 via the ring members 5.

Figure 8:
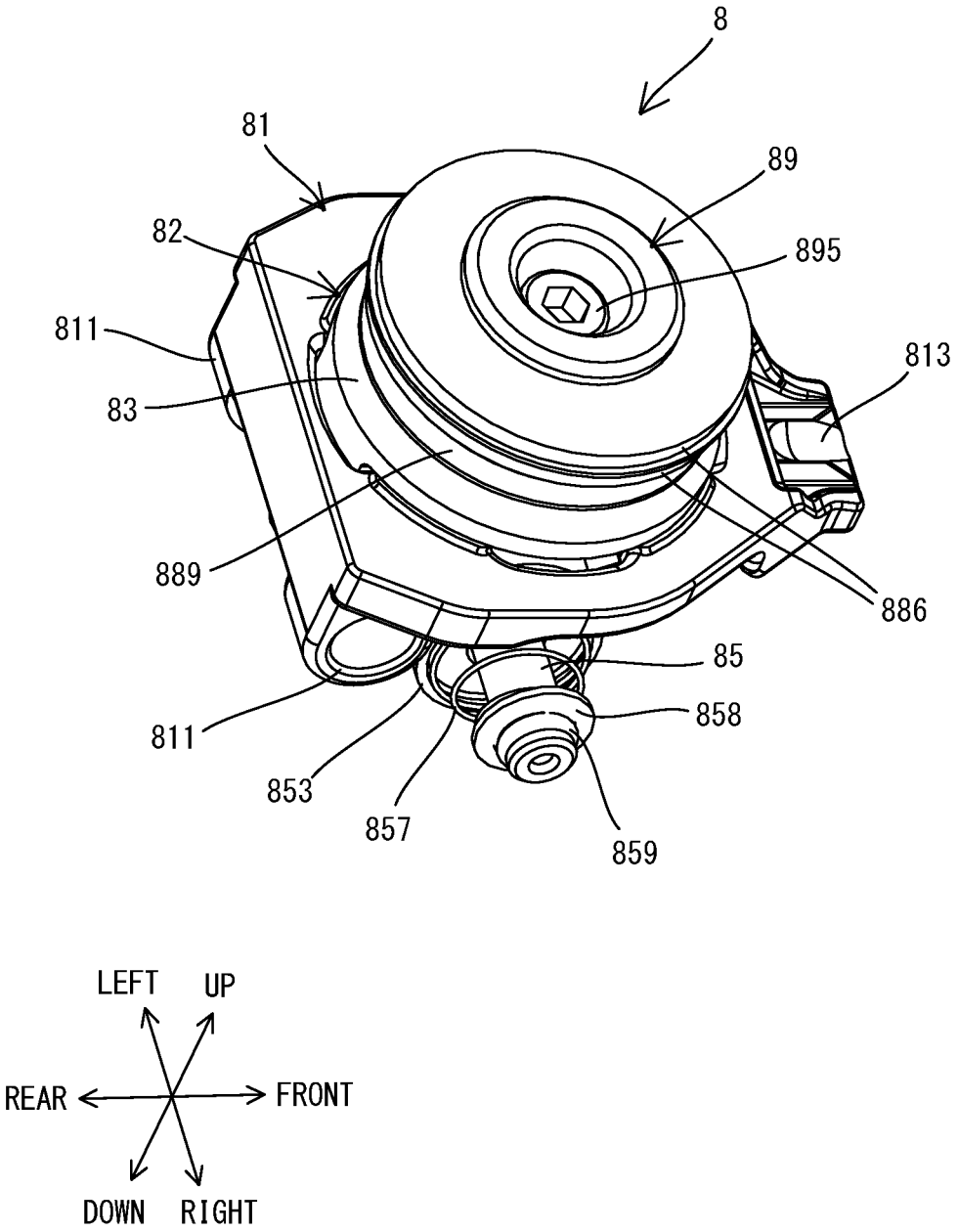
FIG. 8 is a perspective view of the pressing mechanism.
Figure 9:
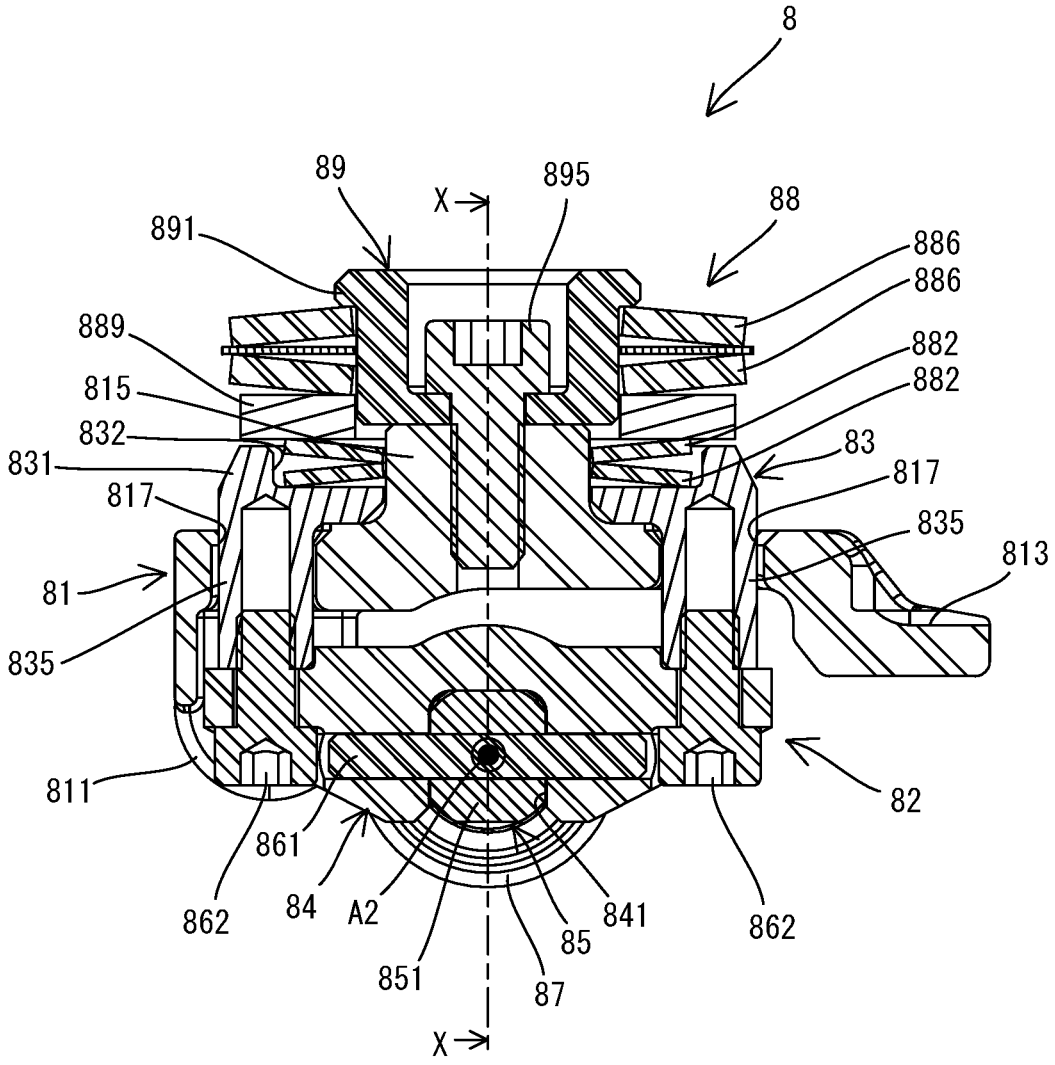
FIG. 9 is a longitudinal sectional view of the pressing mechanism.
Figure 10:
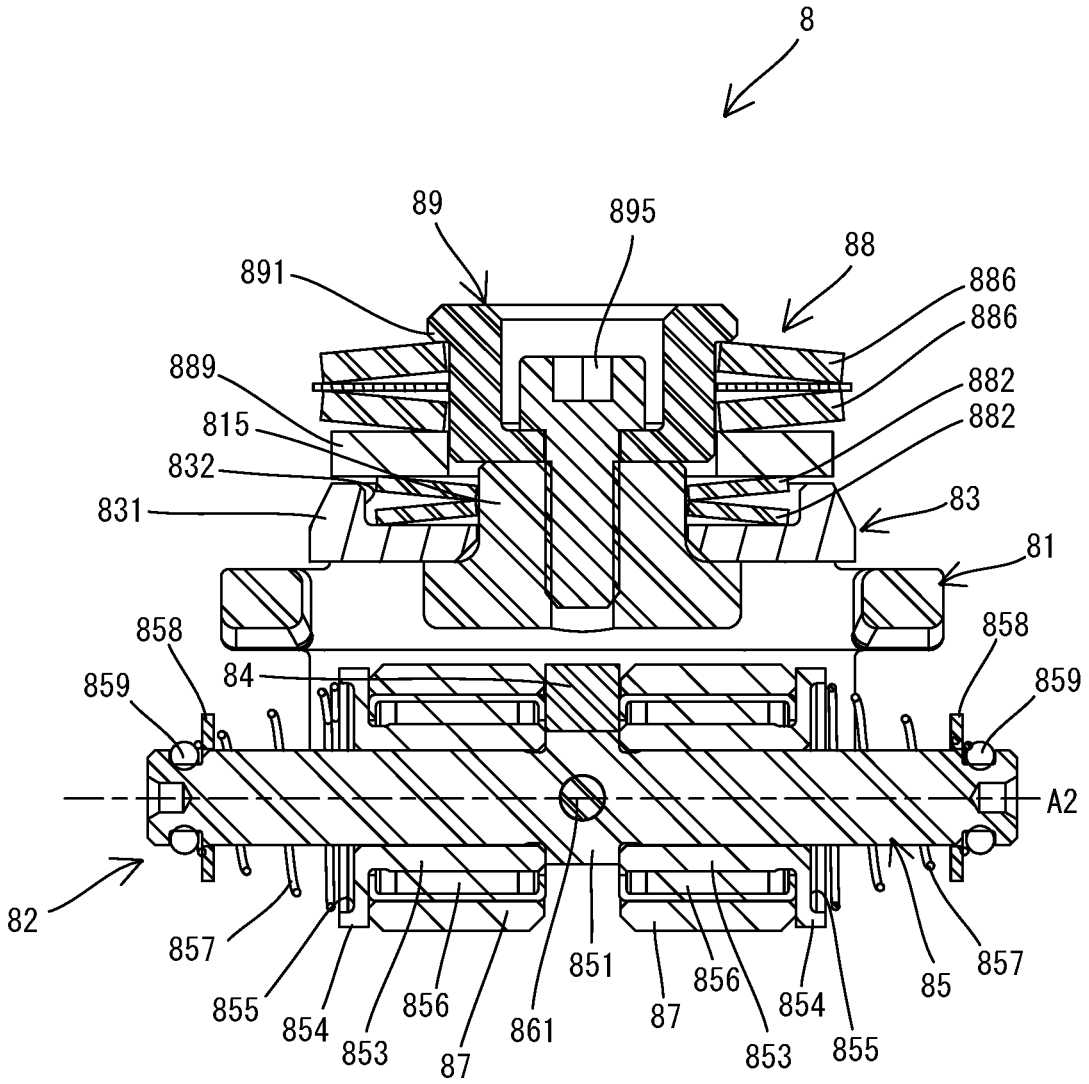
FIG. 10 is a sectional view taken along line X-X in FIG. 9.

As shown in FIGS. 8 to 10, in the present embodiment, the pressing mechanism 8 mainly includes a base member 81, a roller holder 82, the two pressing rollers 87 and a spring mechanism 88. Detailed structures of these components are now described.

The base member 81 is a member which is configured to hold the roller holder 82 such that the roller holder 82 is movable relative to the base member 81. Further, the base member 81 is supported by the body housing 11. As shown in FIG. 8, the base member 81 is a plate-like member having a generally triangular shape as a whole when viewed from above. The base member 81 is arranged such that one of apexes of the triangle is located on its front end. As shown in FIGS. 8 and 9, the base member 81 has rotary parts 811, a lever-locking part 813, a cylindrical part 815 and two support holes 817.

The rotary parts 811 are a pair of left and right cylindrical portions provided on the lower side of a rear end portion of the base member 81. The cylindrical portions are coaxially arranged relative to an axis extending in the left-right direction. Although not shown, a pair of support shafts respectively protrude to the right and left from inner surfaces of left and right side portions of the body housing 11. These support shafts are inserted into the rotary parts 811 (the pair of cylindrical portions) from the left and right, so that the base member 81 is pivotably supported relative to the body housing 11.

The lever-locking part 813 is a portion which is formed in a front end portion of the base member 81 which corresponds to one of the three apexes of the triangle, and has a recess recessed downward. This recess is a portion where a locking lever 119 is locked. As shown in FIG. 1, the base member 81 is normally held in the state that the lever-locking part 813 is locked by the locking lever 119 supported by the body housing 11. The locking lever 119 is configured to be pivotable in an upward direction (counterclockwise direction) from the position shown in FIG. 1. In a case where a trouble such as a jam of the driver 3 occurs, a user can eliminate the trouble by turning the locking lever 119 upward and further turning the base member 81 upward.

As shown in FIGS. 9 and 10, the cylindrical part 815 is a cylindrical portion protruding upward from a central portion of the base member 81. The outer diameter of the cylindrical part 815 is set to be slightly smaller than the inner diameter of disc springs 882 described below. A female thread is formed on an inner peripheral surface of the cylindrical part 815. Further, a spring-holding part 89 having a bottomed cylindrical shape is fixed on the upper side of the cylindrical part 815 via a screw 895. Further, a flange part 891 is formed protruding radially outward on an upper end portion of the spring-holding part 89. The outer diameter of the spring-holding part 89 is set to be slightly smaller than the inner diameter of disc springs 886 described below.

The support holes 817 are respectively provided on the front and rear sides of the cylindrical part 815. Each of the support holes 817 is a through hole extending through the base member 81 in the up-down direction, and has a shape corresponding to a leg part 835 of a frame 83 described below.

The roller holder 82 is a member which is configured to rotatably support the pressing rollers 87. Further, the roller holder 82 is held by the base member 81 so as to be movable in the up-down direction relative to the base member 81. As shown in FIGS. 9 and 10, the roller holder 82 is formed by connecting a frame 83, a shaft-holding part 84 and a support shaft 85.

The frame 83 forms an upper portion of the roller holder 82. The frame 83 includes an annular spring-receiving part 831 and two leg parts 835 protruding downward from the spring-receiving part 831. The spring-receiving part 831 is mounted onto the cylindrical part 815 of the base member 81 and the two leg parts 835 are respectively inserted through the two support holes 817 of the base member 81, so that the frame 83 is held to be movable in the up-down direction relative to the base member 81. It is noted that a recess 832 which is recessed downward is formed in an upper end surface of the spring-receiving part 831. The recess 832 annularly surrounds the cylindrical part 815. Further, a threaded hole, which extends upward from a lower end of the leg part 835, is formed in each of the leg parts 835.

The shaft-holding part 84 is connected to a lower end portion of the frame 83 while holding the support shaft 85, and forms a lower portion of the roller holder 82. More specifically, the shaft-holding part 84 has an elongate shape extending in the front-rear direction. The shaft-holding part 84 has a rectangular fitting recess 841 formed in its central portion and recessed upward from an end surface of the shaft-holding part 84. A rectangular block-like central part 851 of the support shaft 85 is fitted in the fitting recess 841. A connecting pin 861 is inserted through a through hole of the shaft-holding part 84 and a through hole of the central part 851. Thus, the support shaft 85 is held by the shaft-holding part 84 so as to extend in the left-right direction. Further, through holes are respectively formed in front and rear end portions of the shaft-holding part 84 and extend therethrough in the up-down direction. Screws 862 are threadedly engaged with the leg parts 835 of the frame 83 via these through holes, so that the shaft-holding part 84 is connected to the frame 83 while holding the support shaft 85.

As shown in FIG. 10, the two pressing rollers 87 are arranged such that the central part 851 is disposed therebetween. The two pressing rollers 87 are supported by the support shaft 85 extending in the left-right direction so as to be rotatable around a rotation axis A2. The rotation axis A2 extends in parallel to the rotation axis A1 of the flywheel 40. Further, in the present embodiment, the pressing rollers 87 are supported to be movable in the left-right direction along the rotation axis A2. Specifically, each of the pressing rollers 87 is supported by the support shaft 85 via a spring-receiving sleeve 853, which is mounted onto the support shaft 85 so as to be movable in the left-right direction, and a bearing 856 mounted onto the spring-receiving sleeve 853.

The spring-receiving sleeve 853 is cylindrically shaped. The spring-receiving sleeve 853 has a flange part 854 protruding radially outward on its axial end portion. The flange part 854 has an outer diameter larger than an outer diameter of the pressing roller 87. The spring-receiving sleeve 853 is mounted onto the support shaft 85 so as to be slidable in the left-right direction, in a state in which the flange part 854 is located on the distal end side of the support shaft 85. An annular recess 855 is formed on an outer surface (on a surface located on the distal end side of the support shaft 85) of the flange part 854 and recessed inward (toward the central part 851).

One end portion (an end portion on a large diameter side) of a conical coil spring 857 abuts on the recess 855 of the flange part 854. A washer 858 mounted onto the support shaft 85 abuts on the other end portion (an end portion on a small diameter side) of the conical coil spring 857. An O-ring 859 is fitted in each of annular grooves formed on left and right distal end portions of the support shaft 85. The O-ring 859 restricts outward movement (movement toward the distal end of the support shaft 85) of the washer 858. The conical coil spring 857, which is compressed between the flange part 854 and the washer 858, normally biases the spring-receiving sleeve 853, the bearing 856 and the pressing roller 87 toward the central part 851 and holds them in a position in which the spring-receiving sleeve 853 abuts on the central part 851. Thus, the two pressing rollers 87 are normally biased toward each other and held in positions adjacent to the central part 851. These positions are referred to as proximate positions of the pressing rollers 87. When the pressing rollers 87 are in the proximate positions, the distance between the pressing rollers 87 is minimum.

The spring mechanism 88 is provided to bias the pressing rollers 87 toward the driver 3 in the process in which the driver 3 moves forward from the initial position. As shown in FIGS. 9 and 10, in the present embodiment, the spring mechanism 88 includes four disc springs in total. More specifically, the spring mechanism 88 includes two small-diameter disc springs 882 and two large-diameter disc springs 886. The disc springs 882 are mounted onto the cylindrical part 815 and disposed in the recess 832 of the spring-receiving part 831. The disc springs 886 are mounted onto the spring-holding part 89 fixed to the cylindrical part 815. The spring constant of the whole of the two disc springs 886 is larger than the spring constant of the whole of the two disc springs 882. Further, a stopper 889, which defines an upper limit of an amount of displacement of the two disc springs 882, is disposed between the disc spring 882 and the disc spring 886. With such a structure, the spring mechanism 88 has a nonlinear characteristic (a progressive characteristic) that the spring constant of the whole spring mechanism 88 increases when the amount of displacement of the two disc springs 882 exceeds a specified upper limit (specifically, a distance between the stopper 889 and an upper end of the spring-receiving part 831 in the up-down direction).

In the present embodiment, the spring mechanism 88 is disposed between the spring-receiving part 831 of the roller holder 82 and the flange part 891 of the spring-holding part 89 in a slightly loaded (compressed) state. Thus, the base member 81 to which the spring-holding part 89 is fixed and the roller holder 82 are biased away from each other by the spring mechanism 88. Specifically, the base member 81 is biased upward, while the roller holder 82 is biased downward. Therefore, in a state in which an external force of pushing the roller holder 82 upward via the pressing rollers 87 is not applied (in an initial state), as shown in FIGS. 9 and 10, the roller holder 82 is held in a state in which a lower surface of the spring-receiving part 831 abuts on an upper surface of the base member 81. Thus, the roller holder 82 and the pressing rollers 87 are prevented from moving downward by the base member 81 and held in their lowest positions.

Figure 11:
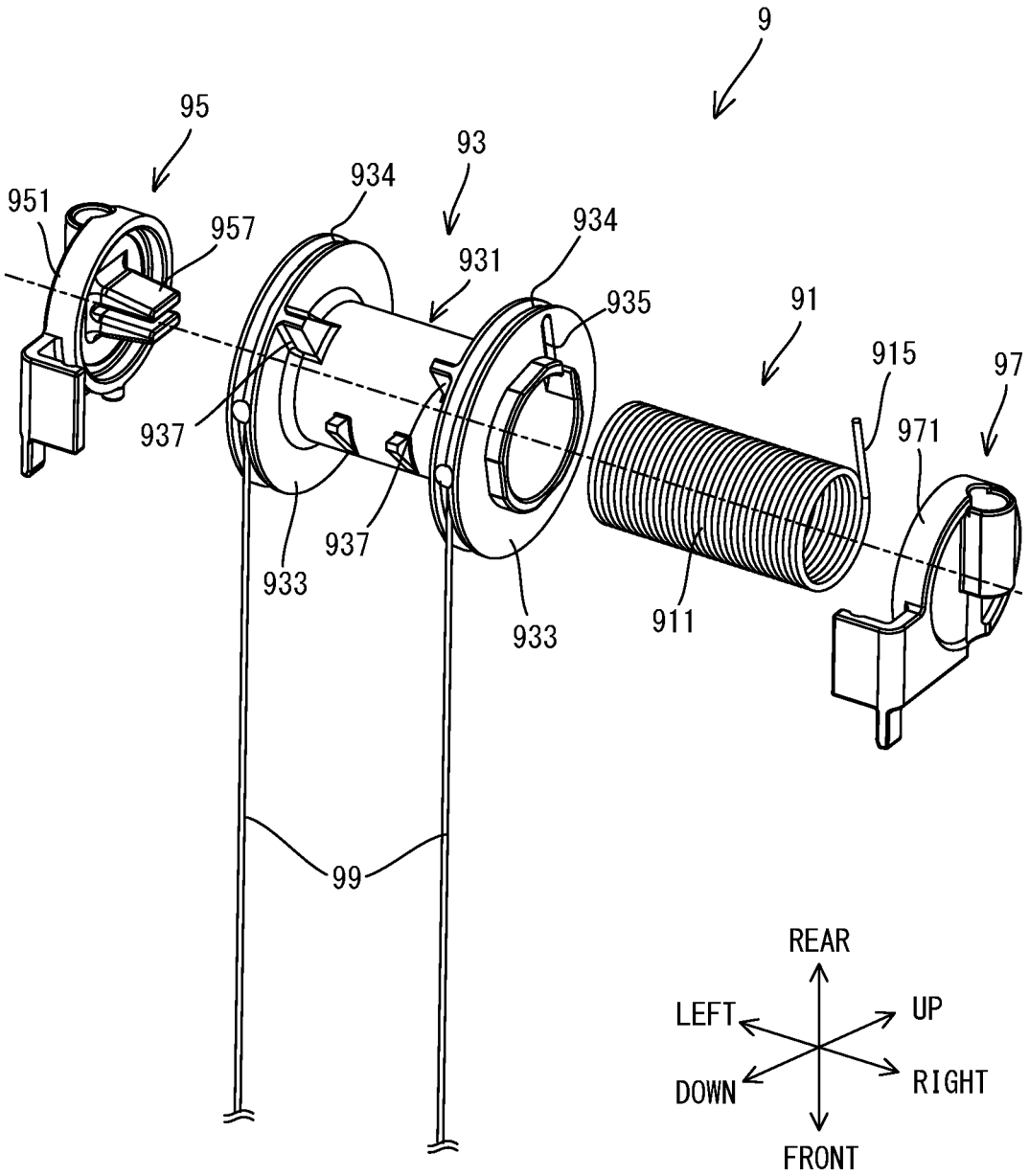
FIG. 11 is an exploded perspective view of a return mechanism.

The return mechanism 9 is described. As shown in FIG. 11, the return mechanism 9 includes a torsion coil spring 91, a winding drum 93, a pair of wires 99, a first support member 95 and a second support member 97.

The winding drum 93 is configured to hold the torsion coil spring 91 and to rotate around a rotation axis which coaxially extends with a center axis of the torsion coil spring 91. In the present embodiment, the winding drum 93 includes a body part 931, a pair of winding parts 933 and a pair of locking parts 937.

The body part 931 is cylindrically formed. The torsion coil spring 91 is housed in an internal space of the body part 931. The winding parts 933 are flange-like portions which respectively protrude radially outward from both end portions of the body part 931. A locking groove 935 is formed in an outside surface of one of the winding parts 933. One end portion of the torsion coil spring 91 which forms an actuation end portion 915 is extended to the outside of the internal space and locked in the locking groove 935. A winding groove 934, on which the wire 99 can be wound, is formed over the whole circumference in an outer periphery of each of the winding parts 933. The pair of locking parts 937 are formed as a pair of protrusions protruding radially outward from the outer peripheral surface of the body part 931. When the driver 3 reaches the nail-driving position, the locking parts 937 are locked to a rotation-stopper part (not shown) to thereby prevent the winding drum 93 from further rotating in a direction of drawing out the wires 99 (hereinafter referred to as a drawing direction). The rotation stopper part is provided on an inner side of the rear end portion of the body housing 11.

Figure 12:
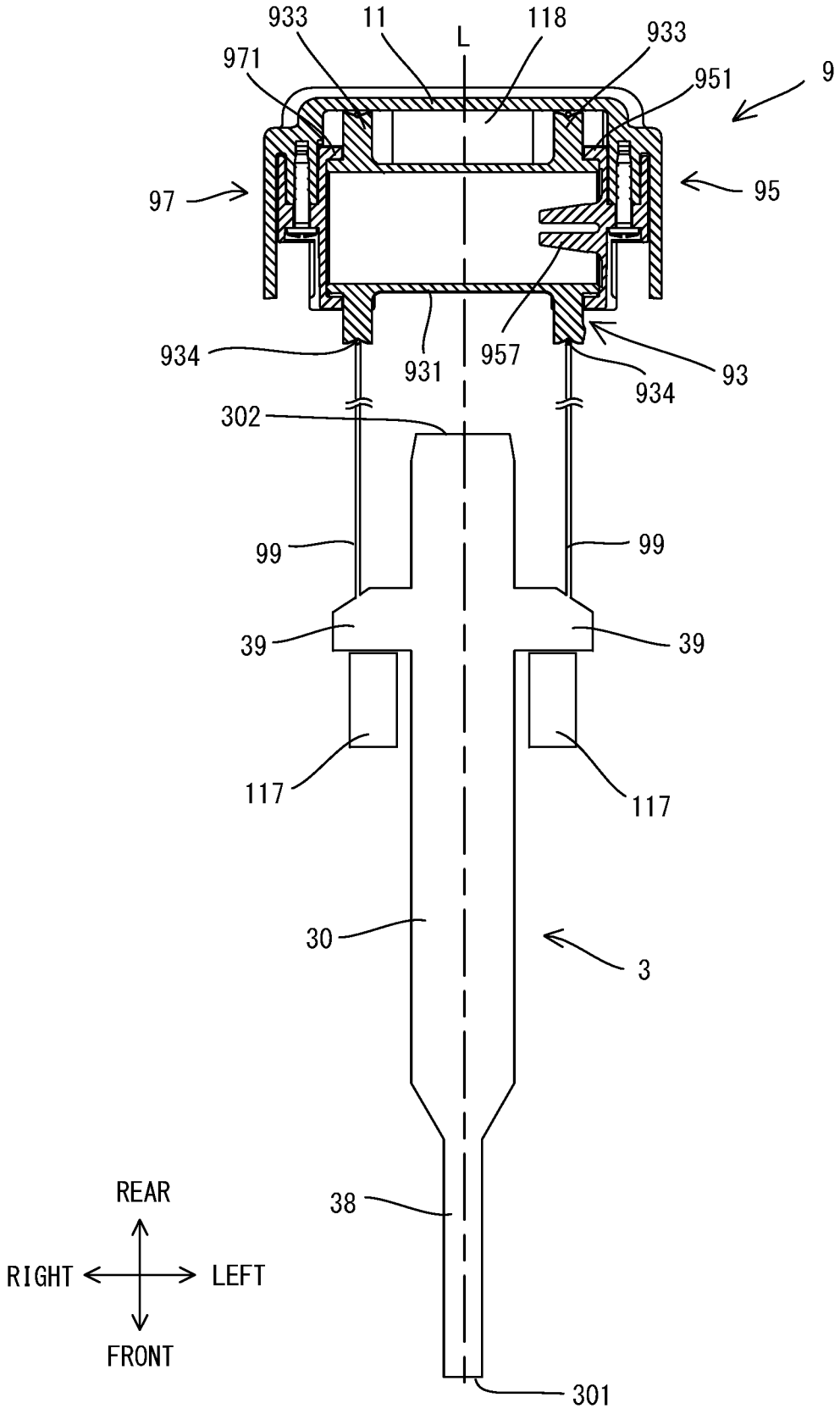
FIG. 12 is an explanatory drawing showing the return mechanism (but not showing a torsion coil spring) and the driver.

Each of the pair of wires 99 is a flexible metal member which connects the winding drum 93 and the driver 3. As shown in FIG. 12, one end of the wire 99 is fixed to the winding groove 934 and the other end is fixed to the arm part 39 of the driver 3.

The first support member 95 and the second support member 97 are configured to rotatably support the winding drum 93 relative to the body housing 11 and to guide rotation of the winding drum 93. More specifically, as shown in FIG. 12, the first support member 95 and the second support member 97 are respectively fixed to left and right side portions of the rear end portion of the body housing 11 with screws. The first support member 95 and the second support member 97 respectively have rotation support parts 951 and 971 which have a bottomed cylindrical shape and which rotatably support both end portions of the winding drum 93 from the left and right. The rotation axis of the winding drum 93 extends in the left-right direction. The winding parts 933 are arranged symmetrically relative to the operation line L of the driver 3.

The first support member 95 and the second support member 97 have an almost symmetrical same shape, except that only the first support member 95 has a spring-fixing part 957 which is configured to fix a fixed end portion (not shown, an end portion opposite to the actuation end portion 915 (see FIG. 11)) of the torsion coil spring 91. The spring-fixing part 957 is configured as two projections protruding to the right from the rotation support part 951. The fixed end portion of the torsion coil spring 91 is held between the two projections and thereby fixed to the first support member 95 and thus to the body housing 11.

Although not shown, in the return mechanism 9 in the initial state, each of the wires 99 is wound almost one turn around the winding part 933 in a winding direction of the actuation end portion 915 (a counterclockwise direction as viewed in FIG. 1). The wire 99 extends forward from a lower end of the winding part 933 and is connected to the arm part 39 of the driver 3. Further, the torsion coil spring 91 is housed and held in the winding drum 93, in a state in which the fixed end portion is fixed to the body housing 11 via the first support member 95 and a load is applied in the winding direction. Thus, the winding drum 93 is biased by the torsion coil spring 91 in a direction of rewinding the actuation end portion 915 (a clockwise direction as viewed in FIG. 1), that is, a direction of winding the wires 99 onto the winding parts 933 (hereinafter referred to as a winding direction. Therefore, the driver 3 is biased rearward via the wires 99, and as shown in FIG. 1, held in the initial position where the rear end 302 is in abutment with the rear stopper part 118.

Operation of the nailing machine 1 having the above-described structure (particularly, positional change of the pressing rollers 87 along with movement of the driver 3) is now described.

Figure 13:
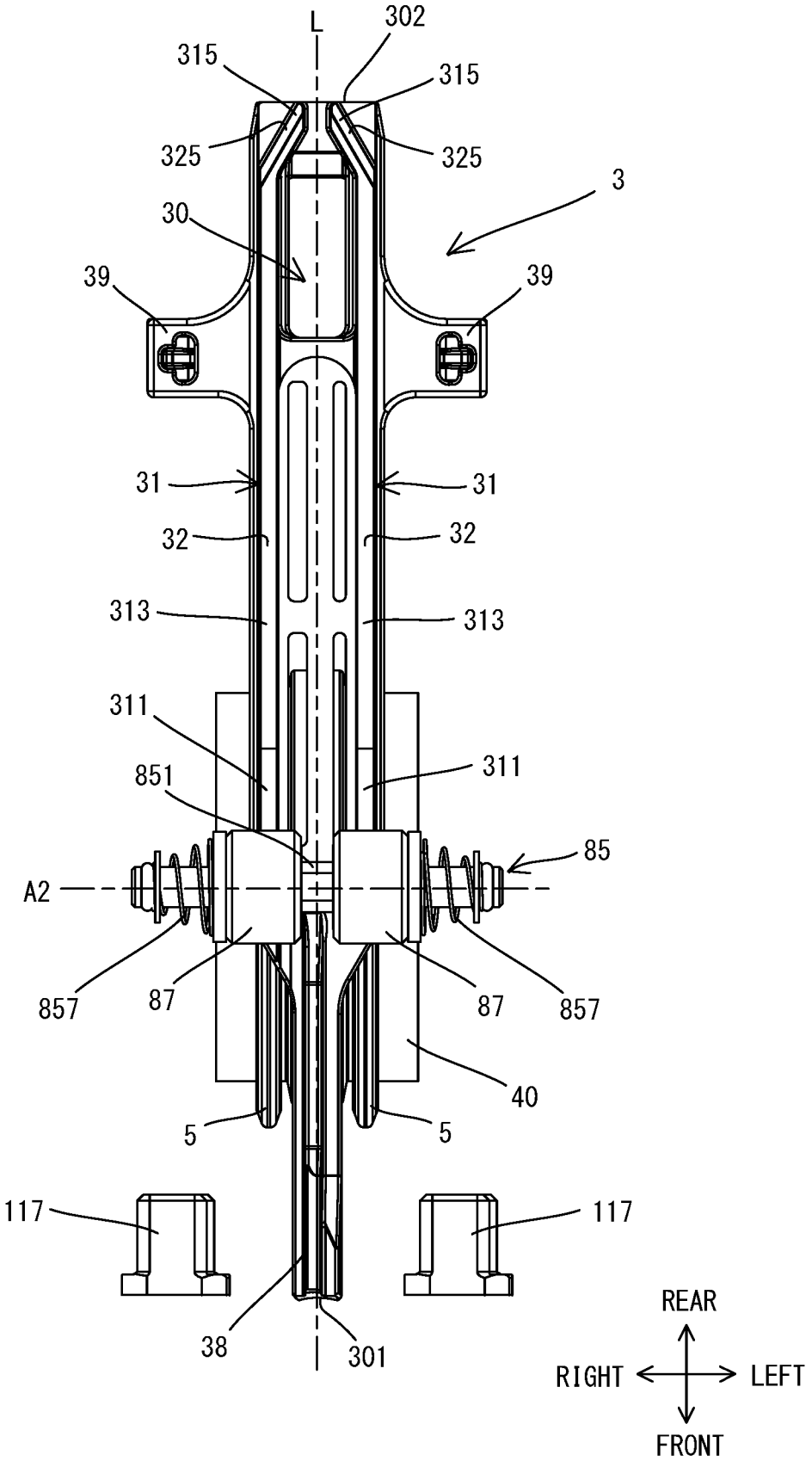
FIG. 13 is a plan view showing the pressing rollers, the driver, the ring members and the flywheel when the driver is located in the initial position.

As described above, in the initial state, the driver 3 is located in the initial position shown in FIG. 2. At this time, a front end of the abutment surface 32 of the roller-abutting part 31 of the driver 3 is located slightly rearward of a lower end of the pressing roller 87 (the rotation axis A2). As shown in FIGS. 7 and 13, the two pressing rollers 87 are held by the biasing forces of the conical coil springs 857 in their proximate positions, which makes the distance between the pressing rollers 87 in the left-right direction to be minimum. Further, as shown in FIG. 7, each of the ring members 5 is held by the holding mechanism 6 in the separate position in which the ring member 5 is slightly apart from the outer periphery 45 (more specifically, the engagement groove 47) of the flywheel 40 in a radially outward direction. Further, each of the pressing rollers 87 is held in the lowest position and in sliding contact with an upper surface of the front end portion (slightly forward of a front end of the push-up part 311) of the body part 30 of the driver 3 from above. However, the pressing rollers 87 are not pressing the driver 3 downward (not applying a load on the driver 3). In this state, the ring member 5 is held in a position where the ring member 5 is also apart from the driver 3. More specifically, the ring member 5 is held in a position where the outer peripheral engagement part 51 is slightly apart downward from the engagement groove 363 of the driver 3.

In this state, when the contact arm 125 is pressed against the workpiece 100 and the contact-arm switch (not shown) is switched on, the motor 2 is driven and the flywheel 40 starts rotating. In this stage, however, each of the ring members 5 is held in the separate position, thus being incapable of transmitting the rotational energy of the flywheel 40 to the driver 3. Therefore, even if the flywheel 40 rotates, the ring members 5 and the driver 3 do not operate.

Thereafter, when a user depresses the trigger 14 to switch on the trigger switch 141, the solenoid 715 is actuated. Then, the push-out lever 711 turns and a rear end portion of the push-out lever 711 presses the lever-abutting part 34 of the driver 3 forward from the rear. Thus, the driver 3 starts moving forward from the initial position toward the nail-driving position along the operation line L. The driver 3 also moves relative to the ring members 5 held in their respective separate positions.

Soon after the driver 3 starts moving, each of the pressing rollers 87 abuts from the front on the abutment surface 32 (specifically, the upper surface of the push-up part 311 having a thickness gradually increasing toward the rear) of the roller-abutting part 31. As the driver 3 moves forward, a portion of the outer peripheral engagement part 51 of each the ring members 5 enters the engagement groove 363 of the driver 3 and abuts on an open end of the engagement groove 363. With the structure in which the inclined part 361 is formed in the front end portion of the ring-engagement part 36 and the engagement groove 363 has a width in the left-right direction increasing toward its open end, the outer peripheral engagement part 51 can smoothly enter the engagement groove 363. When the driver 3 moves forward while each of the pressing rollers 87 abuts on the upper surface of the push-up part 311 and a portion of the outer peripheral engagement part 51 abuts on the open end of the engagement groove 363, the push-up part 311 functions as a cam and further exhibits a wedge effect. Therefore, each of the ring members 5 is pushed downward from the separate position against the biasing forces of the flat springs 601 of the ring-biasing parts 60, and each of the pressing rollers 87 held in the lowest position is pushed upward against the biasing force of the spring mechanism 88.

Figure 14:
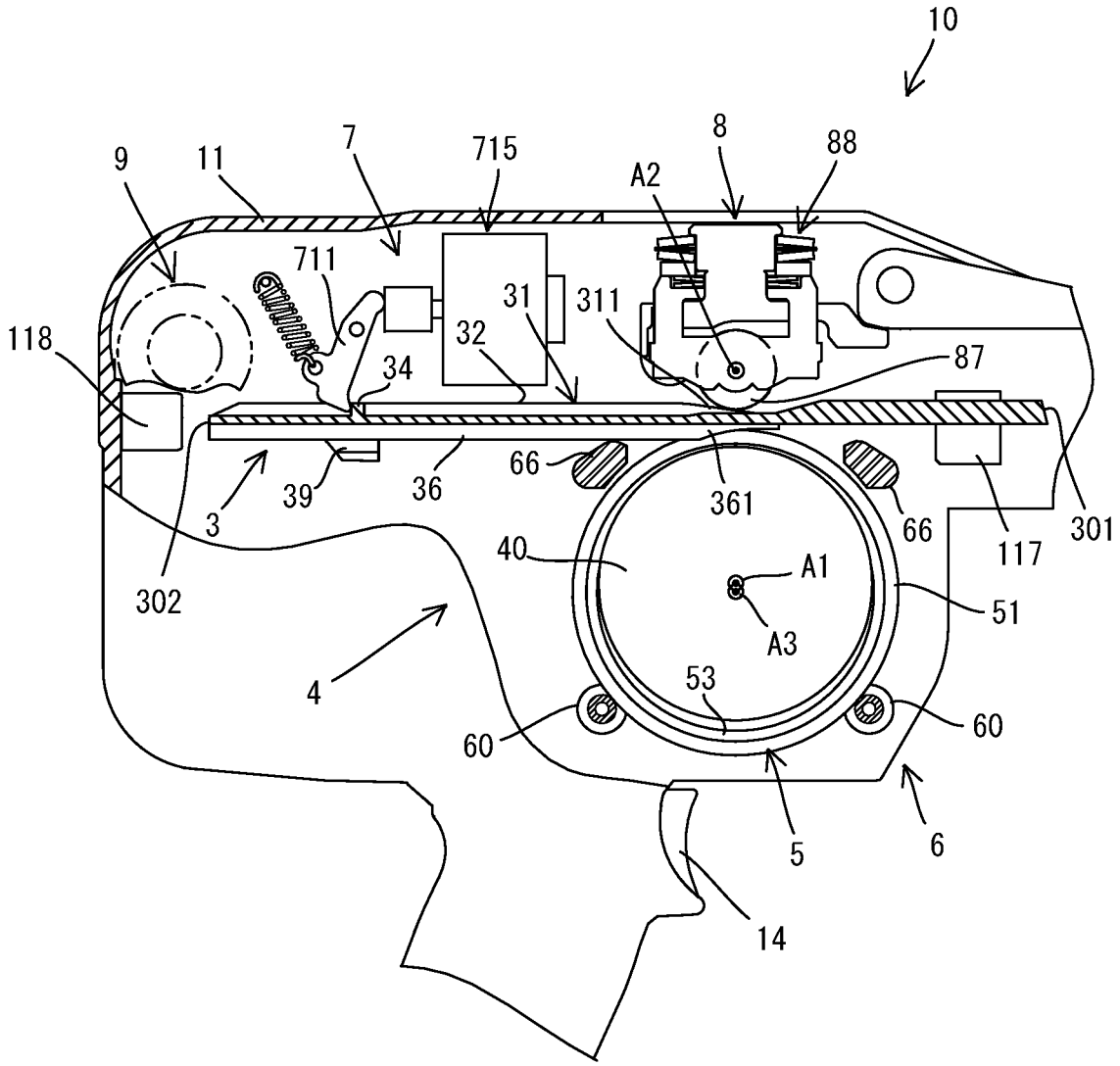
FIG. 14 is an explanatory drawing showing the driver located in a transmitting position and a driver-driving mechanism.
Figure 15:
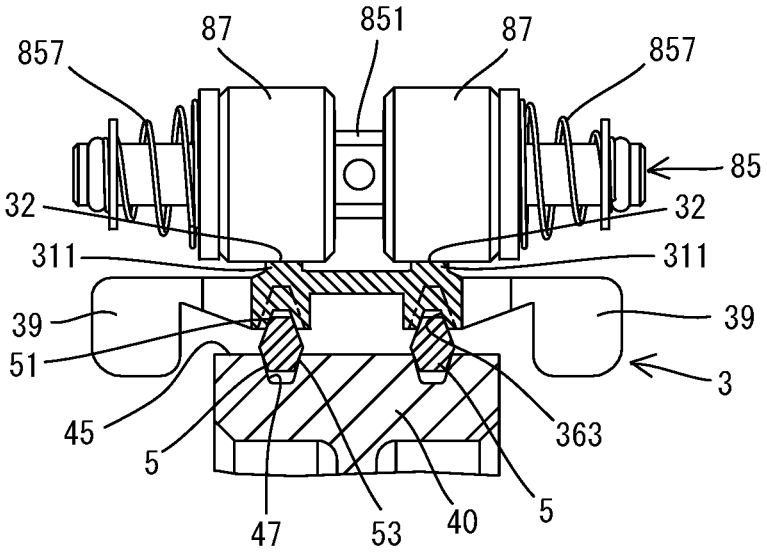
FIG. 15 is an explanatory drawing for illustrating the arrangement of the pressing rollers, the driver, the ring members and the flywheel when the driver is located in the transmitting position.

Then, the driver 3 further moves forward and reaches the transmitting position shown in FIG. 14. The transmitting position is a position where transmission of the rotational energy of the flywheel 40 to the driver 3 is enabled. In the present embodiment, when the driver 3 is placed in the transmitting position, each of the pressing rollers 87 abuts on the upper surface of the middle of the push-up part 311 (a position rearward of the front end of the abutment surface 32). The pressing rollers 87 press the driver 3 downward by the biasing force of the spring mechanism 88 and press the ring members 5 against the flywheel 40. As shown in FIG. 15, a portion of the inner peripheral engagement part 53 of each of the ring members 5 moved downward enters the engagement groove 47 of the flywheel 40 and abuts on an open end of the engagement groove 47, so that the ring member 5 is prevented from further moving downward. Then, a portion of the outer peripheral engagement part 51 of the ring member 5 is frictionally engaged with the driver 3 at the open end of the engagement groove 363 of the driver 3. In addition, a portion of the inner peripheral engagement part 53 of the ring member 5 is frictionally engaged with the flywheel 40 at the open end of the engagement groove 47 of the flywheel 40.

Thus, when each of the ring members 5 is frictionally engaged with the driver 3 and the flywheel 40, the ring member 5 becomes capable of transmitting the rotational energy of the flywheel 40 to the driver 3. It is noted that the "frictionally engaged" state refers to a state that the two members are engaged with each other by frictional force (which state may include a sliding state). The ring member 5 is rotated around a rotation axis A3 by the flywheel 40 while only the portion of the inner peripheral engagement part 53 of the ring member 5 which is pressed against the flywheel 40 by the driver 3 is frictionally engaged with the flywheel 40.

At this time, each of the ring members 5 is rotatably supported in the lowest position by the ring-biasing parts 60 while being held apart from the stoppers 66, and only a portion of the inner peripheral engagement part 53 abuts on the upper portion of the flywheel 40. In other words, the ring member 5 is held in the contact position by the holding mechanism 6. Further, in the left-right direction, the pressing rollers 87 are still held in the proximate positions (see FIG.

13) by the biasing forces of the conical coil springs 857 while the driver 3 moves from the initial position to the transmitting position.

In the present embodiment, as shown in FIG. 14, the ring member 5 is formed to have a larger diameter than the flywheel 40, and the inner diameter of the ring member 5 is larger than the outer diameter of the flywheel 40 (strictly, the diameter from the rotation axis A1 of the flywheel 40 to the bottom of the engagement groove 47). Therefore, the rotation axis A3 of the ring member 5 is different from the rotation axis A1 of the flywheel 40 and disposed below the rotation axis A1 (further apart from the driver 3). It is noted that the rotation axis A3 extends in parallel to the rotation axis A1. The ring members 5 push out the driver 3, which is frictionally engaged with the ring members 5, forward from the transmitting position shown in FIG. 14. Thus, the driver 3 receives the rotational energy transmitted from the flywheel 40 via the ring members 5 and moves forward from the transmitting position.

It is noted that in the process that the driver 3 moves from the initial position to the transmitting position, the whole spring mechanism 88 (the four disc springs 882 and 886) is compressed. The spring constant (a combined spring constant) of the whole spring mechanism 88 is relatively small, so that the pressing rollers 87 softly press the driver 3. Further, in this process, the disc springs 882 having a smaller spring constant (which are softer) than the disc springs 886 are more strongly compressed and significantly displaced earlier than the disc springs 886. When the driver 3 reaches the transmitting position, the upper surface of the spring-receiving part 831 abuts on the lower surface of the stopper 889, so that the disc springs 882 are prevented from being further displaced.

In the process in which the driver 3 moves forward from the transmitting position and the pressing rollers 87 are further pushed up by the push-up parts 311, only the disc springs 886 having a larger spring constant are displaced. Therefore, the rate of increase in the load relative to the amount of displacement of the spring mechanism 88 becomes higher than in the moving process of the driver 3 from the initial position to the transmitting position. Therefore, the pressing rollers 87 strongly press the driver 3 against the ring members 5 by increased load of the spring mechanism 88 as the pressing rollers 87 are pushed up by the push-up parts 311. Thus, the frictional engagement between the driver 3 and the portion of the outer peripheral engagement part 51 and between the flywheel 40 and the portion of the inner peripheral engagement part 53 gets firmer, so that each of the ring members 5 more efficiently transmits the rotational energy of the flywheel 40 to the driver 3.

Figure 16:
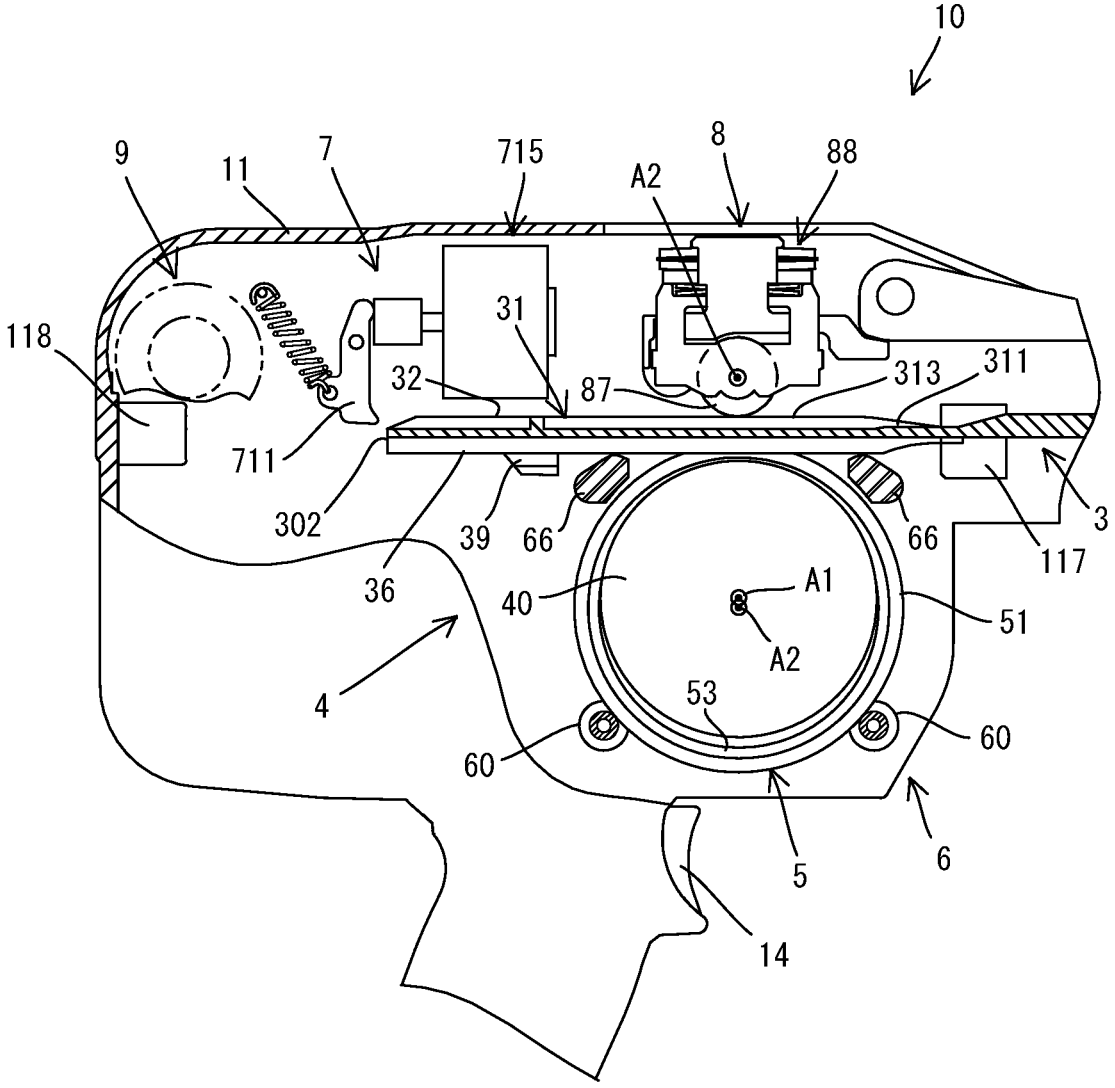
FIG. 16 is an explanatory drawing showing the driver located in a striking position and the driver-driving mechanism.
Figure 17:
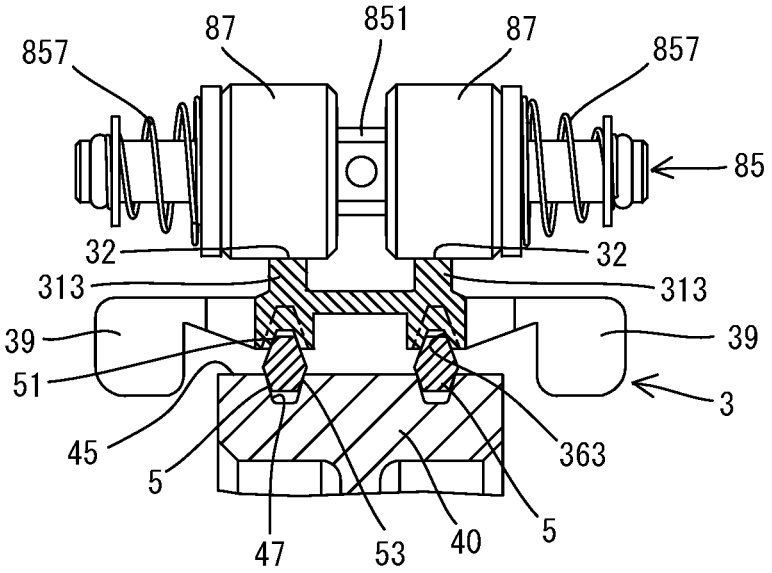
FIG. 17 is an explanatory drawing for illustrating the arrangement of the pressing rollers, the driver, the ring members and the flywheel when the driver is located in the striking position.
Figure 18:
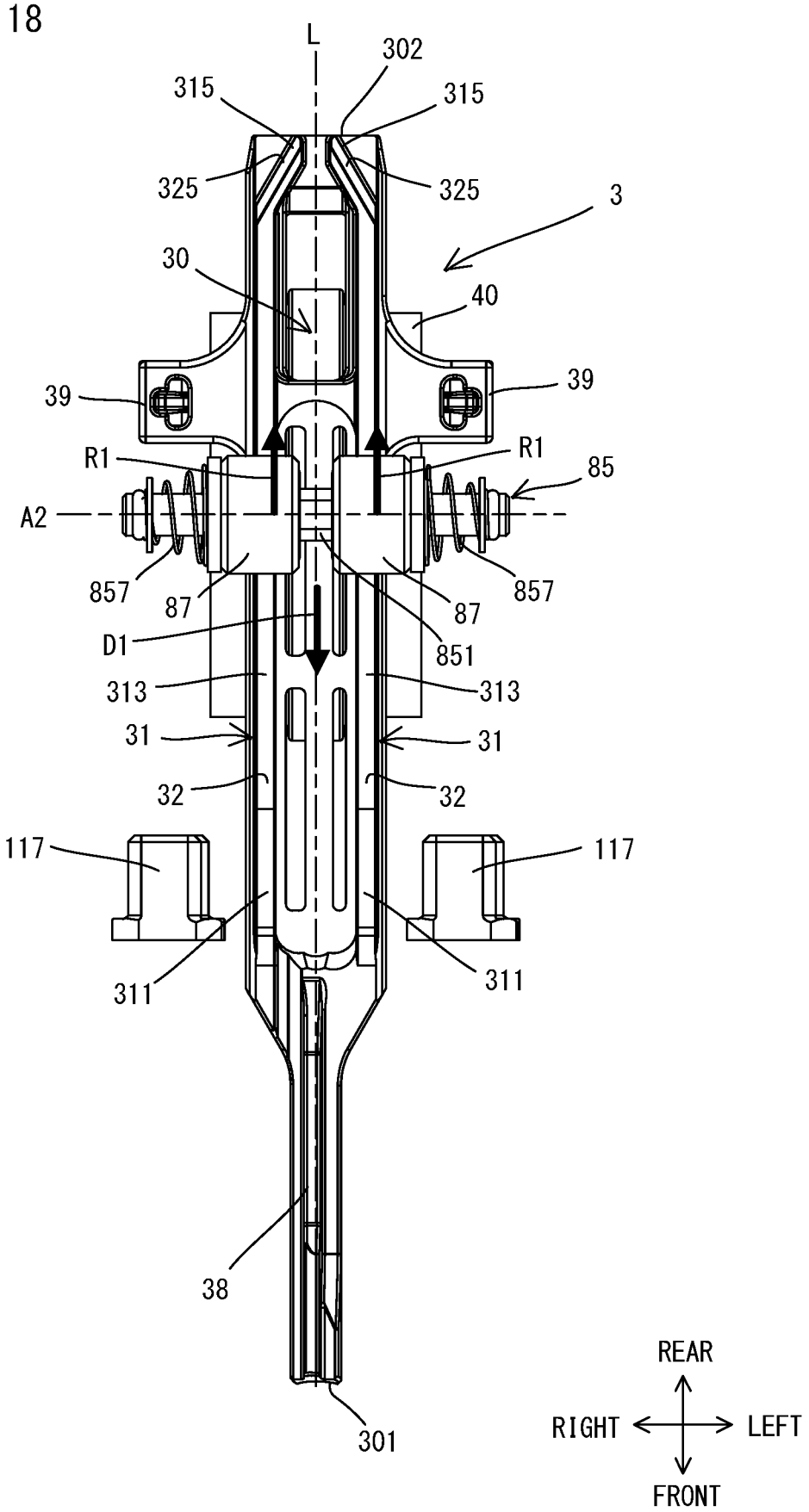
FIG. 18 is a plan view showing the pressing rollers, the driver, the ring members and the flywheel when the driver is located in the striking position.

When the driver 3 further moves forward and each of the pressing rollers 87 is placed on the upper surface of the straight part 313 extending rearward from the push-up part 311, the amount of displacement of the spring mechanism 88 reaches the upper limit and does not further increase. Therefore, the load of the whole spring mechanism 88 also reaches the upper limit and is kept constant. The driver 3 moves forward while being strongly pressed against the ring members 5 by the pressing rollers 87 and thus prevented from sliding, and strikes the nail 101. FIGS. 16 to 18 show a state in which the driver 3 is located in a striking position where the driver 3 strikes the nail 101 (see FIG. 1). In the present embodiment, when the driver 3 is located in the striking position, each of the pressing rollers 87 abuts on the upper surface of the middle of the straight part 313. In FIG. 18, arrows D1 and R1 denote a direction of movement of the driver 3 and a direction of movement of the pressing roller 87 relative to each other, respectively. The pressing rollers 87 are still held in the proximate positions in the left-right direction while the driver 3 moves from the transmitting position to the striking position. When a specified time required for the driver 3 to reach the striking position elapses after the trigger switch 141 is switched on, the controller 18 stops supply of current to the solenoid 715 to thereby return the push-out lever 711 to the initial position.

Figure 19:
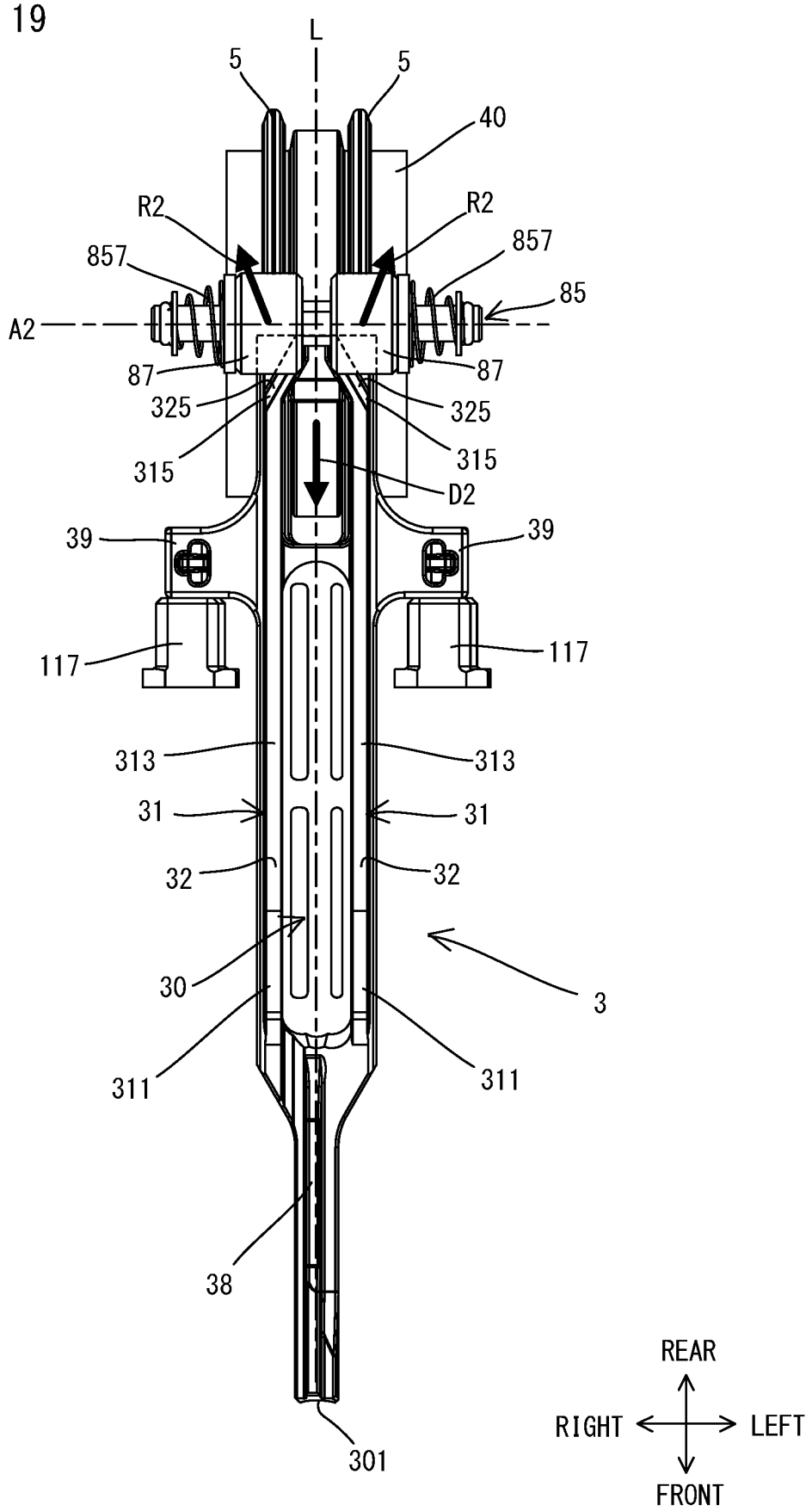
FIG. 19 is a plan view showing the pressing rollers, the driver, the ring members and the flywheel in a final stage of a nail-driving process.

Then, the driver 3 further moves forward from the striking position and each of the pressing rollers 87 reaches the roller-guide part 315 extending rearward from the straight part 313. As described above, each of the roller-guide parts 315 has the guide surface 325. The pair of guide surfaces 325 are arranged in a V-shape having an apex on a rear end when viewed from above, and also inclined downward toward the rear. Therefore, as shown in FIG. 19, as the driver 3 moves forward as shown by arrow D2, the pair of left and right pressing rollers 87 biased downward by the spring mechanism 88 move downward and away from each other in the left-right direction relative to the driver 3, as shown by arrows R2, while sliding on the guide surfaces 325. In the meantime, the load on the spring mechanism 88 (see FIG. 16), which has been compressed to the maximum extent, is reduced, so that the pressing force of the pressing rollers 87 against the driver 3 is reduced. Since the pair of guide surfaces 325 are inclined as described above, a component of the pressing force from each of the pressing rollers 87 in the front-rear direction acts as a forward driving force for the driver 3. Therefore, the driving force of the driver 3 increases, so that the driver 3 is suitably prevented from slipping relative to the ring members 5 due to its resistance which increases as the operation of driving the nail 101 into the workpiece progresses in the final stage of the nail-driving process.

The driver 3 further moves to the nail-driving position shown in FIG. 5 and drives the nail 101 into the workpiece 100. The driver 3 stops moving when a front ends of the arm parts 39 of the driver 3 abut on the front stopper parts 117 from the rear. Each of the pressing rollers 87 passes a rear end of the guide surface 325 of the roller-guide part 315 just before the driver 3 reaches the nail-driving position. When the driver 3 reaches the nail-driving position, the rear end 302 of the driver 3 (the rear ends of the guide surfaces 325) is located forward of the rotation axis A2 of the pressing rollers 87. Further, each of the pressing rollers 87 is placed in the lowest position, but not pressing the driver 3 downward. Therefore, the frictional engagement between the driver 3 and the ring members 5 is released. Further, the ring members 5, which have been pressed against the flywheel 40 via the driver 3, are biased upward by the flat springs 601 of the holding mechanism 6 (see FIG. 6), so that the frictional engagement between the ring members 5 and the flywheel 40 is released. Therefore, transmission of the rotational energy from the flywheel 40 to the driver 3 via the ring members 5 is interrupted.

In this state, when the user releases pressing of the contact arm 125 against the workpiece 100 and the contact-arm switch (not shown) is switched off, the controller 18 stops driving of the motor 2. Then, the flywheel 40 also stops rotating.

The return mechanism 9 (see FIGS. 11 and 12) is actuated when transmission of the rotational energy to the driver 3 is interrupted. In the nail-driving process, interlocking with the forward movement of the driver 3, the wires 99 connected to the arm parts 39 are pulled forward and thus drawn out from the respective winding parts 933. In the meantime, the winding drum 93 is rotated in the drawing direction against the biasing force of the torsion coil spring 91, thus imparting further elastic force to the torsion coil spring 91. When transmission of the rotational energy to the driver 3 is interrupted, the winding drum 93 is rotated in the winding direction by this elastic force of the torsion coil spring 91. Thus, the driver 3 is pulled rearward by the wires 99 being wound up onto the respective winding drums 93 and starts moving rearward from the nail-driving position to the initial position.

Figure 20:
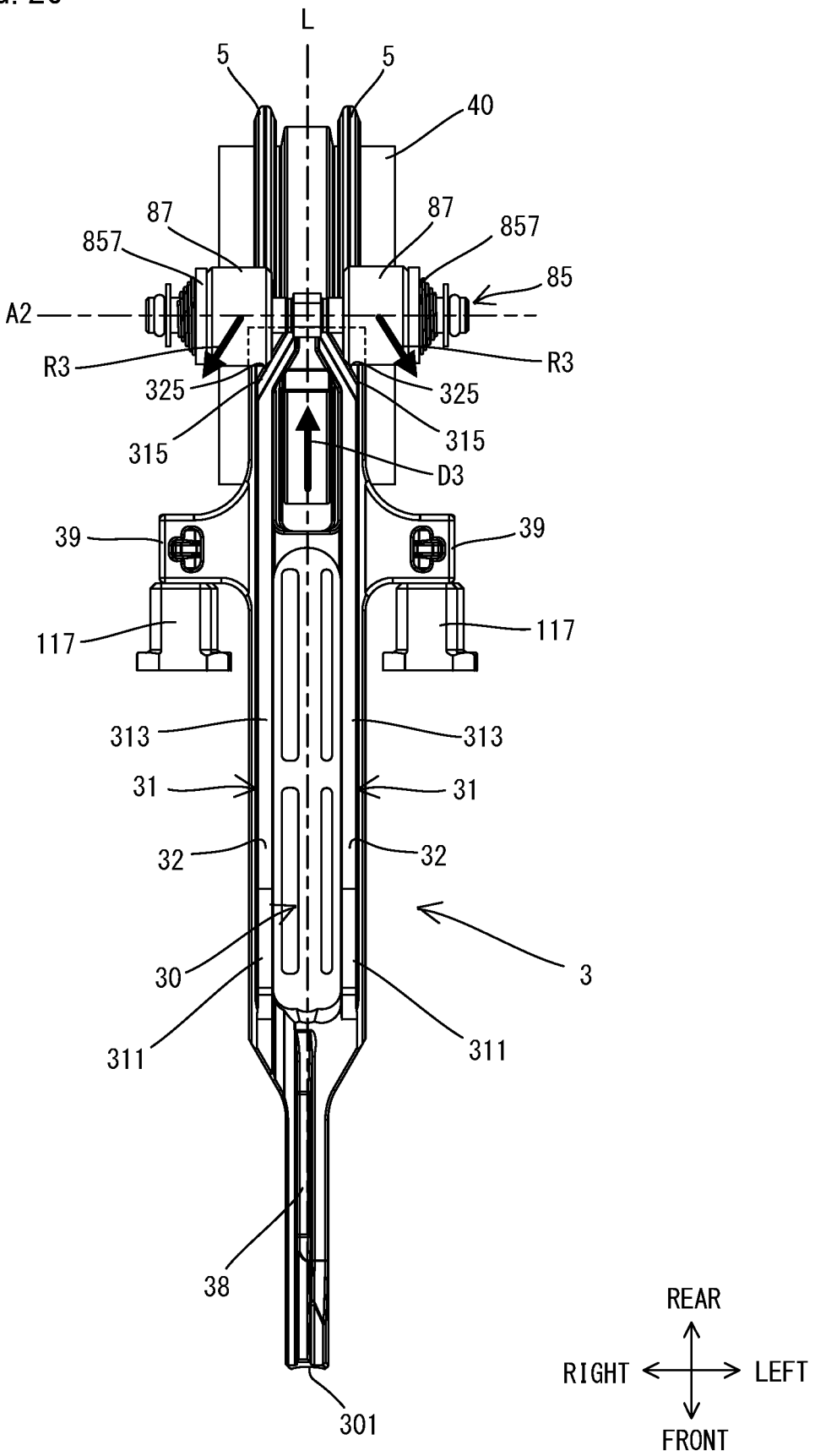
FIG. 20 is a plan view showing the pressing rollers, the driver, the ring members and the flywheel in an initial stage of a return process.

When the driver 3 starts moving rearward, each of the pressing rollers 87 abuts on the rear end of the guide surface 325 from the rear. As described above, the guide surfaces 325 are inclined such that the distance therebetween increases in the left-right direction (inclined in a direction away from each other) toward the front. Therefore, as shown in FIG. 20, as the driver 3 moves rearward as shown by arrow D3, the pressing rollers 87 move forward relative to the driver 3 while being guided to move away from each other in the left-right direction by the guide surfaces 325 as shown by arrows R3, against the biasing forces of the conical coil springs 857. It is noted that, in the up-down direction, the pressing rollers 87 are held in their lowest positions. In other words, the two pressing rollers 87 are not pushed upward by the guide surfaces 325. The two pressing rollers 87 move away from each other along the guide surfaces 325 as the pressing rollers 87 move forward relative to the driver 3.

Figure 21:
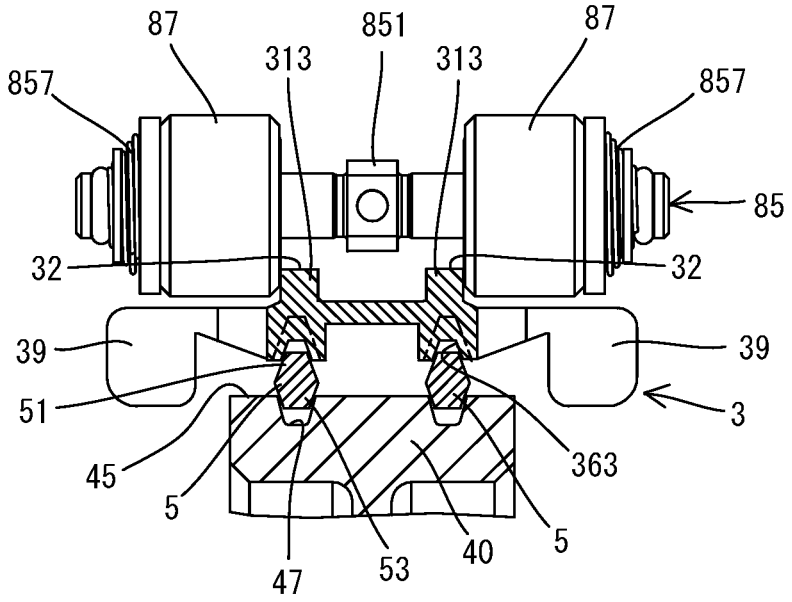
FIG. 21 is an explanatory drawing for illustrating the arrangement of the pressing rollers, the driver, the ring members and the flywheel in the middle of the return process.
Figure 22:
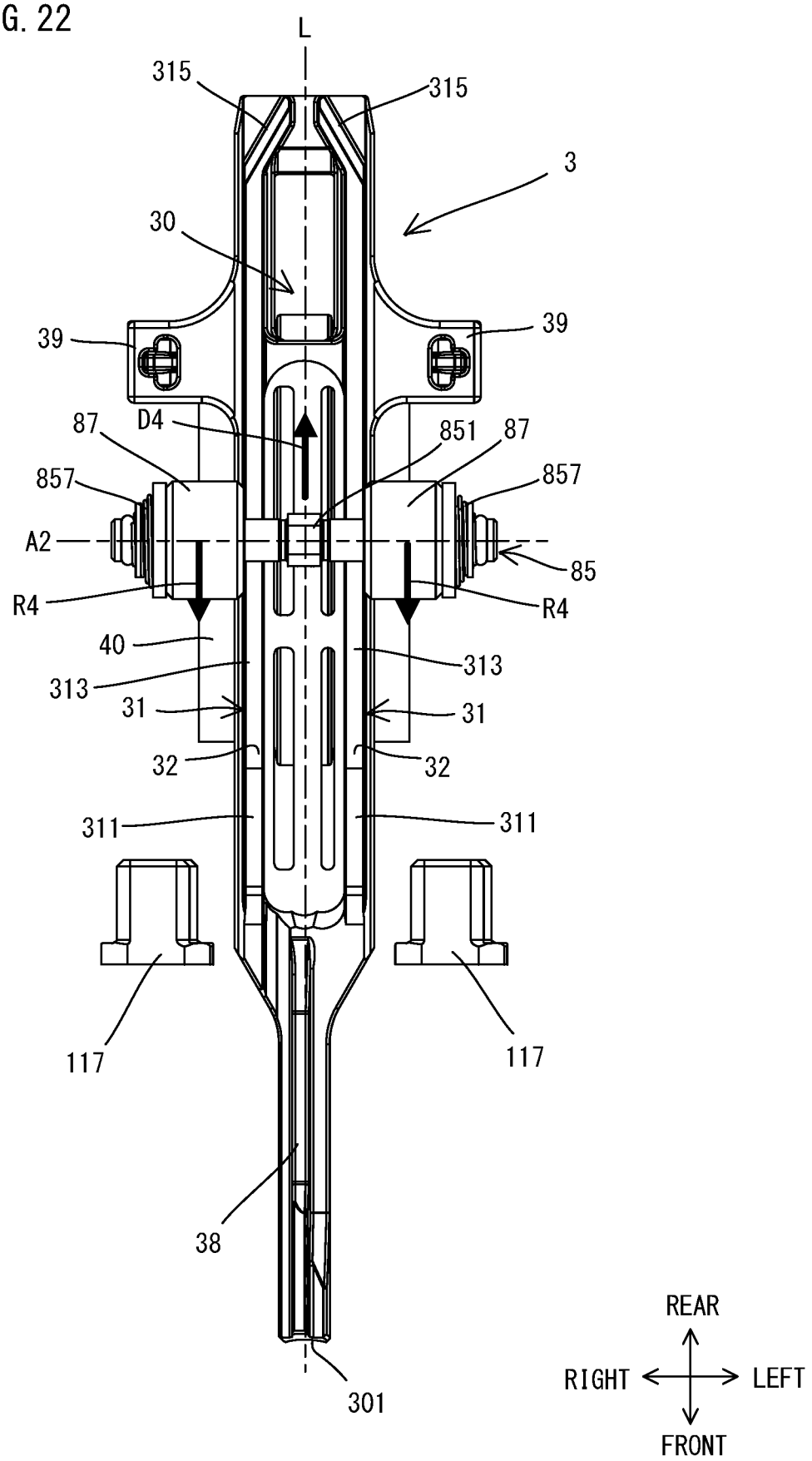
FIG. 22 is a plan view showing the pressing rollers, the driver, the ring members and the flywheel in the middle of the return process.

When the driver 3 further moves rearward, the pressing rollers 87 respectively reach outer sides (left and right sides) of the associated straight parts 313 while being held in their lowest positions in the up-down direction. As shown in FIG. 21, the two pressing rollers 87 are respectively held in abutment with the outer sides of the pair of left and right straight parts 313 by the biasing forces of the conical coil springs 857. At this time, the distance between the pressing rollers 87 becomes maximum. Thereafter, as shown in FIG. 22, as the driver 3 moves rearward as shown by arrow D4, the pressing rollers 87 move forward, as shown by arrows R4, relative to the driver 3 while being guided along the straight parts 313 in abutment with the opposite outer sides of the pair of straight parts 313. When the driver 3 further moves rearward, the pressing rollers 87 similarly move forward relative to the driver 3 while being guided along the push-up parts 311 in abutment with the opposite outer sides (left and right sides) of the pair of left and right push-up parts 311.

When the driver 3 returns to the initial position shown in FIGS. 2 and 13, where the roller-abutting parts 31 are not interposed between the pressing rollers 87, the pressing rollers 87 are biased toward each other by the conical coil springs 857 and return to their proximate positions.

In the present embodiment, as described above, in the nail-driving process, the pressing rollers 87 press the driver 3 downward by the biasing force of the spring mechanism 88 and thus enables transmission of the rotational energy from the flywheel 40 to the driver 3 via the ring members 5. Further, the positions of the pressing rollers 87 relative to the driver 3 change in the left-right direction (that is, in the extending direction of the rotation axis A2 of the pressing rollers 87) between the nail-driving process and the return process. Thus, in the return process, the pressing rollers 87 become incapable of pressing the driver 3. Therefore, the pressing rollers 87 can be prevented from inhibiting the movement of the driver 3 from the nail-driving position to the initial position. The positions of the pressing rollers 87 relative to the driver 3 in the left-right direction can be changed by linearly moving the pressing rollers 87 in the left-right direction. Therefore, a space required for the movement of the pressing rollers 87 can be reduced, for example, compared with a pressing mechanism configured to swing a roller assembly for supporting a pressing roller to thereby release pressing of the pressing roller against a driver. Thus, size increase of the pressing mechanism 8 can be suppressed.

Further, in the present embodiment, the driver 3 has the roller-abutting parts 31 configured to abut on the pressing rollers 87 in the nail-driving process. Each of the roller-abutting parts 31 has the abutment surface 32 (specifically, a portion of the abutment surface 32, extending from a portion which abuts on the pressing roller 87 when the driver 3 is placed in the transmitting position to a rear end of the abutment surface 32 (the guide surface 325)) which is to be pressed by the pressing roller 87 while the driver 3 receives the rotational energy in the nail-driving process. The rear end of the abutment surface 32 is located forward of the rotation axis A2 of the pressing rollers 87 when the driver 3 is placed in the nail-driving position. Specifically, when the driver 3 moves forward and is placed in the nail-driving position in the nail-driving process, the pressing rollers 87 are not located on the abutment surfaces 32, so that the driver 3 does not receive the rotational energy. Therefore, a state can be established in which pressing of the pressing rollers 87 against the driver 3 is released at the start of the return process in which the driver 3 moves from the nail-driving position to the initial position.

Further, in the present embodiment, the two pressing rollers 87 are arranged on the opposite sides of the operation line L in the left-right direction, and biased toward each other by the conical coil springs 857. Further, in the nail-driving process, the pressing rollers 87 are held in the proximate positions by the biasing forces of the conical coil springs 857. On the other hand, in the return process, the pressing rollers 87 are held in positions in which the pressing rollers 87 are further apart from each other than in the proximate positions, against the biasing forces of the conical coil springs 857. More specifically, in the return process, the pressing rollers 87 are respectively guided along the roller-abutting parts 31 moving rearward, in abutment with the opposite outer sides of the roller-abutting parts 31 due to the biasing forces of the conical coil springs 857. Further, when the driver 3 returns to the initial position, the pressing rollers 87 are released from abutment with the roller-abutting parts 31 and return to the proximate positions by the biasing forces of the conical coil springs 857.

Thus, in the present embodiment, in the return process and when the driver 3 is back to the initial position, the pressing rollers 87 can be held in appropriate positions in the left-right direction by utilizing the roller-abutting parts 31 and the biasing forces of the conical coil springs 857. Further, it is not necessary to separately provide a structure for holding the pressing rollers 87 in positions to be separated further apart from each other than in the proximate positions in the return process. Therefore, size increase and complication of the pressing mechanism 8 can be prevented. Further, in the present embodiment, the length of the pressing mechanism 8 (specifically, of the support shaft 85) in the left-right direction can be reduced by using the conical coil springs 857 each having a smaller solid height than a cylindrical coil spring.

Further, in the present embodiment, a rear end portion (specifically, the roller-guide parts 315 which respectively form the rear end portions of the roller-abutting parts 31) of the driver 3 has the pair of guide surfaces 325. The guide surfaces 325 are inclined such that the distance therebetween increases in the left-right direction toward the front (arranged in a V-shape having an apex on a rear end when viewed from above). Therefore, in the return process, the pair of guide surfaces 325 can guide the pressing rollers 87 to move away from each other in the left-right direction. In other words, as the driver 3 moves rearward from the nail-driving position, the guide surfaces 325 can separate the pressing rollers 87 from each other in the left-right direction. Therefore, it is not necessary to separately provide a structure for moving the pressing rollers 87, so that size increase and complication of the pressing mechanism 8 can be prevented.

Further, the pair of guide surfaces 325 are inclined downward (in a direction away from the pressing rollers 87) toward the rear. Therefore, in the nail-driving process, the pair of guide surfaces 325 can guide the two pressing rollers 87 to move away from each other while reducing the pressing force of the pressing rollers 87 against the driver 3. In other words, when the driver 3 moves toward the nail-driving position in the nail-driving process, the pair of guide surfaces 325 of the present embodiment can separate the pressing rollers 87 from each other in the left-right direction while allowing the pressing rollers 87 to move downward and thus reducing the pressing force of the pressing rollers 87 against the driver 3. Therefore, after reaching the nail-driving position, the driver 3 can smoothly shift to the return process.

In the present embodiment, as described above, the pair of guide surfaces 325 can achieve a function of guiding separation of the two pressing rollers 87 in the return process and a function of reducing the pressing force of the pressing rollers 87 and guiding separation of the pressing rollers 87 in the nail-driving process. Therefore, the structure of the driver 3 can be made simple.

The above-described embodiment is merely an example, and a driving tool according to the present invention is not limited to the structure of the nailing machine 1 of the above-described embodiment. For example, the following modifications may be made. Further, only one or a plurality of these modifications may be adopted in combination with the nailing machine 1 of the above-described embodiment or the claimed invention.

The driving tool may be a driving tool for driving out a fastener other than the nail 101. For example, the driving tool may be embodied as a tacker or a staple gun for driving out a rivet, a pin or a staple. Further, the driving source of the flywheel 40 is not particularly limited to the motor 2. For example, an AC motor may be adopted in place of the DC motor.

The shape of the driver 3 and the structure of the driver-driving mechanism 4 which drives the driver 3 may be appropriately changed. For example, the roller-abutting part 31 of the driver 3 may be modified as follows. For example, only one roller-abutting part 31 may be provided, in place of the pair of roller-abutting parts 31. The push-up part 311 may be formed linearly as a whole, or in a gentle circular arc shape at least in part, when viewed from the side. In other words, an upper surface (the abutment surface 32) of the push-up part 311 may be flat or curved in its entirety, or flat or curved in part. Further, the push-up part 311 may have an inclination which varies halfway. The push-up part 311 may be formed longer. The length of the straight part 313 may be changed, or the straight part 313 may be omitted. Specifically, the push-up part 311 having a gradually increasing thickness may be longer and the roller-guide part 315 may be formed to extend from the rear end of the push-up part 311.

The length and/or the direction of inclination of the pair of guide surfaces 325 of the roller-guide parts 315 may be appropriately changed. For example, the pair of guide surfaces 325 may be merely inclined such that the distance therebetween increases in the left-right direction toward the front. In other words, the guide surfaces 325 may only have the function of guiding separation of the two pressing rollers 87 in the return process. Alternatively, the guide surfaces 325 may be inclined only downward (in a direction away from the pressing rollers 87) toward the rear. In other words, the guide surfaces 325 may only have the function of reducing the pressing force of the pressing rollers 87 in the nail-driving process. Further, the guide surfaces 325 may be omitted.

The structure of the pressing mechanism 8 may be appropriately changed. For example, in the pressing mechanism 8, the structure for holding the spring mechanism 88, the structure for supporting the pressing rollers 87, the structure for displacing the spring mechanism 88 along with movement of the driver 3 etc. may be appropriately changed. For example, the structures of the base member 81 and/or the roller holder 82 are not limited to those of the present embodiment. Further, for example, the spring mechanism 88 need not necessarily consist of the disc springs 882 and 886 having different spring constants from each other. Specifically, the kind, number and spring constant of springs may be appropriately changed. When a plurality of springs are adopted, a manner of connecting the springs may also be appropriately selected.

The number of the pressing rollers 87 may be one or three or more. In a case where the two pressing rollers 87 are adopted, the pressing rollers 87 may be biased toward each other by a different kind of springs (such as a cylindrical coil spring and a flat spring) from the conical coil springs 857. Further, the pressing rollers 87 may be moved in the left-right direction other than by cooperation between the roller-abutting parts 31 of the driver 3 and the conical coil springs 857. For example, the pressing rollers 87 may be guided by a member which is different from the roller-abutting part 31 in the return process. The pressing mechanism 8 may be separately provided with a structure for moving the two pressing rollers 87 in the left-right direction when the driver 3 is placed in the nail-driving position.

The return mechanism 9 may be appropriately modified. For example, it may be configured to return the driver 3 from the nail-driving position to the initial position by an elastic force of a compression coil spring, in place of the torsion coil spring 91.

The manner of engagement of the ring members 5 with the driver 3 and the flywheel 40 is not limited to the manner of engagement exemplified in the above-described embodiment. For example, the number of the ring members 5 and the numbers of the engagement grooves 363 of the driver 3 and the engagement grooves 47 of the flywheel 40 which correspond to the ring members 5 may be one or three or more. Further, for example, the shapes, arrangements, numbers and engagement positions of the outer and inner peripheral engagement parts 51 and 53 and the corresponding engagement grooves 363 and 47 may be appropriately changed. The ring member 5 may be held such that the ring member 5 is incapable of transmitting the rotational energy of the flywheel 40 to the driver 3 when the driver 3 is located in the initial position, and such that the ring member 5 starts transmission of the rotational energy when the driver 3 is moved to the transmitting position. Therefore, the structures of the ring-biasing parts 60 and the stoppers 66 of the holding mechanism 6 may be appropriately changed.

Further, in place of the driver-driving mechanism 4, a driving mechanism may be adopted which is configured to directly press the driver 3 against the flywheel 40 by the pressing mechanism 8 to thereby transmit the rotational energy not via the ring members 5 but directly from the flywheel 40 to the driver 3. Alternatively, the rotational energy of the flywheel 40 may be transmitted to the driver 3 via a transmitting member (such as a roller) other than the ring members 5 which is disposed between the flywheel 40 and the driver 3.

Correspondences between the components of the above-described embodiment and modifications and the components of the present invention are as follows. The nailing machine 1 is an example of the "driving tool" according to the present invention. The nail 101 is an example of the "fastener" according to the present invention. The tool body 10 and the ejection outlet 123 are examples of the "tool body" and the "ejection outlet", respectively, according to the present invention. The flywheel 40 is an example of the "flywheel" according to the present invention. The rotation axis A1 is an example of the "first rotation axis" according to the present invention. The driver 3 is an example of the "driver" according to the present invention. The operation line L is an example of the "operation line" according to the present invention. The pressing mechanism 8, the spring mechanism 88 and the pressing rollers 87 are examples of the "pressing mechanism", the "first biasing part", and the "at least one pressing roller" or the "two rollers", respectively, according to the present invention. The rotation axis A2 is an example of the "second rotation axis" according to the present invention. The return mechanism 9 is an example of the "return mechanism" according to the present invention.

The roller-abutting part 31 is an example of the "roller-abutting part" according to the present invention. The abutment surface 32 (specifically, a portion of the abutment surface 32, extending from a portion which abuts on the pressing roller 87 when the driver 3 is placed in the transmitting position to the rear end of the abutment surface 32 (the guide surface 325)) is an example of the "pressing-force-receiving surface" according to the present invention. The conical coil spring 857 is an example of the "second biasing part" according to the present invention. The pair of guide surfaces 325 are an example of the "pair of guide surfaces" according to the present invention.

Further, in view of the nature of the present invention and the above-described embodiment, the following structures (aspects) are provided. Only one or a plurality of the following structures may be adopted in combination with any of the nailing machine 1 of the above-described embodiment, its modifications and the claimed invention.

(Aspect 1)

The roller-abutting part may be configured to have a thickness at least partially changing in the facing direction, and at least a front end portion of the roller-abutting part may be configured such that the thickness gradually increases toward the rear.

(Aspect 2)

A front end of the pressing-force-receiving surface may be located rearward of the second rotation axis when the driver is located in the initial position.

(Aspect 3)

The pair of guide surfaces may be provided on a rear end portion of the roller-abutting part.

(Aspect 4)

The pair of guide surfaces may be provided in a rear end portion of the pressing-force-receiving surface.

(Aspect 5)

The pressing mechanism may include:

a base member supported by the tool body; and a roller holder configured to rotatably support the pressing roller and held by the base member so as to be movable in the facing direction relative to the base member, wherein:

the first biasing part may be interposed between the base member and the roller holder so as to bias the pressing roller toward the driver.

(Aspect 6)

The driving tool may further comprise:

a ring member configured to transmit the rotational energy of the flywheel to the driver; and an actuating mechanism configured to move the driver forward relative to the ring member from an initial position to a transmitting position where the ring member is capable of transmitting the rotational energy to the driver, wherein:

when the driver is located in the initial position, the ring member is loosely fitted onto the outer periphery of the flywheel, and when the driver is moved to the transmitting position by the actuating mechanism, the driver is pressed against the ring member by the pressing roller, whereby the ring member is frictionally engaged with the driver and the flywheel and rotated by the flywheel around a rotation axis different from a rotation axis of the flywheel, thereby transmitting the rotational energy to the driver.

(Aspect 7)

In aspect 6, the driving tool may further comprise a holding mechanism configured to hold the ring member such that the ring member is movable between a separate position in which the ring member is apart from the outer periphery of the flywheel and a contact position in which the ring member is in partial contact with the outer periphery, and when the driver is located in the initial position, the holding mechanism may hold the ring member in the separate position, and when the driver is moved to the transmitting position by the driver moving mechanism, the holding mechanism may hold in the contact position the ring member which is moved along with movement of the driver.

DESCRIPTION OF NUMERALS

1: nailing machine, 10: tool body, 11: body housing, 117: front stopper part, 118: rear stopper part, 119: locking lever, 12: nose part, 123: ejection outlet, 125: contact arm, 13: handle, 14: trigger, 141: trigger switch, 15: battery mounting part, 17: magazine, 18: controller, 19: battery, 2: motor, 21: pulley, 25: belt, 3: driver, 301: front end, 302: rear end, 30: body, 31: roller-abutting part, 311: push-up part, 313: straight part, 315: roller-guide part, 32: abutment surface, 325: guide surface, 34: lever-abutting part, 36: ring-engagement part, 361: inclined part, 363: engagement groove, 38: striking part, 39: arm part, 4: driver-driving mechanism, 40: flywheel 41: pulley, 45: outer periphery, 47: engagement groove, 5: ring member, 51: outer peripheral engagement part, 53: inner peripheral engagement part, 6: holding mechanism, 60: ring-biasing part, 601: flat spring, 66: stopper, 7: actuating mechanism, 711: push-out lever, 715: solenoid, 8: pressing mechanism, 81: base member, 811: rotary part, 813: lever-locking part, 815: cylindrical part, 817: support hole, 82: roller holder, 83: frame, 831: spring-receiving part, 832: recess, 835: leg part, 84: shaft-holding part, 841: fitting recess, 85: support shaft, 851: central part, 853: spring-receiving sleeve, 854: flange part, 855: recess, 856: bearing, 857: conical coil spring, 858: washer, 859: O-ring, 861: connecting pin, 862: screw, 87: pressing roller, 88: spring mechanism, 882: disc spring, 886: disc spring, 889: stopper, 89: spring-holding part, 891: flange part, 895: screw, 9: return mechanism, 91: torsion coil spring, 915: actuation end portion, 93: winding drum, 931: body, 933: winding part, 934: winding groove, 935: locking groove, 937: locking part, 95: first support member, 951: rotation support part, 957: spring-fixing part, 97: second support member, 971: rotation support part, 99: wire, 100: workpiece, 101: nail, A1: rotation axis, A2: rotation axis, A3: rotation axis, L: operation line

The invention claimed is:

1. A driving tool configured to eject a fastener from an ejection outlet to drive the fastener into a workpiece, the driving tool comprising:

a tool body extending in a front-rear direction of the driving tool and having the ejection outlet on a front end of the tool body;

a flywheel housed in the tool body and configured to be rotationally driven around a first rotation axis, the first rotation axis extending in a direction orthogonal to the front-rear direction;

a driver disposed to face an outer periphery of the flywheel and to be movable between an initial position and a nail-driving position along an operation line extending in the front-rear direction, the driver being configured to move forward by rotational energy transmitted from the flywheel to thereby strike and drive the fastener into the workpiece;

a pressing mechanism disposed on a side opposite to the flywheel across the driver in a facing direction in which the flywheel and the driver face each other, the pressing mechanism including a first biasing part and at least one roller, the at least one roller being supported to be rotatable around a second rotation axis and to be movable in an extending direction of the second rotation axis, the second rotation axis extending in parallel to the first rotation axis, the at least one roller being configured to press the driver toward the flywheel by a biasing force of the first biasing part in a nail-driving process in which the driver moves from the initial position to the nail-driving position, to thereby enable transmission of the rotational energy to the driver; and a return mechanism configured to move the driver rearward from the nail-driving position to the initial position along the operation line, wherein:

the pressing mechanism is configured such that a position of the at least one roller relative to the driver changes in the extending direction of the second rotation axis between the nail-driving process and a return process in which the driver moves from the nail-driving position to the initial position, thereby making the at least one roller to be incapable of pressing the driver in the return process.

2. The driving tool as defined in claim 1, wherein:

the driver has a roller-abutting part extending in the front-rear direction and configured to abut on the at least one roller in the nail-driving process, the roller-abutting part has a pressing-force-receiving surface to be pressed by the roller in a state in which the driver receives the rotational energy in the nail-driving process, and a rear end of the pressing-force-receiving surface is located forward of the second rotation axis when the driver is placed in the nail-driving position.

3. The driving tool as defined in claim 1, wherein:

the at least one roller includes two rollers arranged on opposite sides of the operation line in the extending direction of the second rotation axis, the pressing mechanism includes a second biasing part configured to bias the two rollers toward each other, and the two rollers are configured to be held in proximate positions where the two rollers are proximate to each other by a biasing force of the second biasing part in the nail-driving process, and to be held in positions where the two rollers are separated further apart from each other than in the proximate positions against the biasing force in the return process.

4. The driving tool as defined in claim 3, wherein a rear end portion of the driver has a pair of guide surfaces which are at least inclined such that a distance between the pair of guide surfaces in the extending direction of the second rotation axis increases toward the front.

5. The driving tool as defined in claim 4, wherein the pair of guide surfaces are inclined in a direction away from the two rollers toward the rear.

6. The driving tool as defined in claim 5, wherein rear ends of the pair of guide surfaces are located forward of the second rotation axis when the driver is placed in the nail-driving position.

7. The driving tool as defined in claim 3, wherein:

the driver has at least one roller-abutting part, the at least one roller-abutting part extending in the front-rear direction and being configured to abut on the two rollers in the nail-driving process, and the two rollers are guided along the at least one roller-abutting part respectively in abutment with opposite sides of the roller-abutting part by the biasing force of the second biasing part in the return process, and when the driver returns to the initial position, the two rollers are released from abutment with the at least one roller-abutting part and return to the proximate positions by the biasing force of the second biasing part.

8. The driving tool as defined in claim 7, wherein a rear end portion of the at least one roller-abutting part has a pair of guide surfaces which are at least inclined such that a distance between the pair of guide surfaces in the extending direction of the second rotation axis increases toward the front.

9. The driving tool as defined in claim 8, wherein the pair of guide surfaces are inclined in a direction away from the two rollers toward the rear.

10. The driving tool as defined in claim 9, wherein rear ends of the pair of guide surfaces are located forward of the second rotation axis when the driver is placed in the nail-driving position.

11. The driving tool as defined in claim 7, wherein:

the at least one roller-abutting part is configured to have a thickness at least partially changing in the facing direction, and at least a front end portion of the at least one roller-abutting part is configured such that the thickness gradually increases toward the rear.

12. The driving tool as defined in claim 7, wherein the at least one roller-abutting part includes two roller-abutting parts corresponding to the two rollers.

13. The driving tool as defined in claim 3, wherein the second biasing part includes two springs respectively biasing the two rollers toward each other.

14. The driving tool as defined in claim 13, wherein each of the two springs is a conical coil spring.

15. The driving tool as defined in claim 13, wherein:

the pressing mechanism further includes:

a shaft extending along the second rotation axis; and two sleeves supported by the shaft so as to be slidable relative to the shaft in the extending direction of the second rotation axis, the two rollers are respectively supported by the two sleeves to be rotatable, and the two springs respectively bias the two sleeves toward each other.

16. The driving tool as defined in claim 15, wherein:

the pressing mechanism further includes a base member supported by the tool body and holding the shaft to be movable in the facing direction, and the first biasing part is interposed between the base member and the shaft, and configured to bias the two rollers, via the shaft, toward the driver.

17. The driving tool as defined in claim 3, wherein:

the driver has two roller-abutting parts, the two roller-abutting parts extending in the front-rear direction and being configured to abut on and to be pressed by the two rollers in the nail-driving process, the pressing mechanism further includes:

a shaft extending along the second rotation axis; and two sleeves supported by the shaft so as to be slidable relative to the shaft in the extending direction of the second rotation axis, the two rollers are respectively supported by the two sleeves to be rotatable, the second biasing part includes two springs respectively biasing the two sleeves toward each other, and the two rollers are guided along the two roller-abutting parts respectively in abutment with opposite sides of the two roller-abutting parts by biasing forces of the two springs in the return process, and when the driver returns to the initial position, the two rollers are released from abutment with the two roller-abutting parts and return to the proximate positions by the biasing forces of the two springs.

18. The driving tool as defined in claim 17, wherein rear end portions of the two roller-abutting parts have a pair of guide surfaces which are at least inclined such that a distance between the pair of guide surfaces in the extending direction of the second rotation axis increases toward the front.

19. The driving tool as defined in claim 18, wherein the pair of guide surfaces are inclined in a direction away from the two rollers toward the rear.

20. The driving tool as defined in claim 19, wherein rear ends of the pair of guide surfaces are located forward of the second rotation axis when the driver is placed in the nail-driving position.

* * * * *